US008358255B2

(12) United States Patent
Yoshihama et al.

(10) Patent No.: US 8,358,255 B2
(45) Date of Patent: Jan. 22, 2013

(54) PLASMA DISPLAY DEVICE AND DRIVING METHOD OF PLASMA DISPLAY PANEL

(75) Inventors: Yutaka Yoshihama, Osaka (JP); Shigeo Kigo, Osaka (JP)

(73) Assignee: Panasonic Corporation, Osaka (JP)

( * ) Notice: Subject to any disclaimer, the term of this patent is extended or adjusted under 35 U.S.C. 154(b) by 1143 days.

(21) Appl. No.: 12/296,131

(22) PCT Filed: Feb. 25, 2008

(86) PCT No.: PCT/JP2008/000322

§ 371 (c)(1),
(2), (4) Date: Oct. 6, 2008

(87) PCT Pub. No.: WO2008/105159

PCT Pub. Date: Sep. 4, 2008

(65) Prior Publication Data

US 2009/0184952 A1 Jul. 23, 2009

(30) Foreign Application Priority Data

Feb. 27, 2007 (JP) ..... 2007-046484
Feb. 27, 2007 (JP) ..... 2007-046485

(51) Int. Cl.
*G09G 3/28* (2006.01)

(52) U.S. Cl. ..... 345/63; 345/60; 345/67; 348/173

(58) Field of Classification Search ..... 345/60–72
See application file for complete search history.

(56) References Cited

U.S. PATENT DOCUMENTS 7,133,008 B2 11/2006 Naganuma
7,688,287 B2 3/2010 Tokunaga
7,965,259 B2 * 6/2011 Onizuka et al. ..... 345/63
2003/0001804 A1 * 1/2003 Naganuma ..... 345/63
2003/0090488 A1 * 5/2003 Yoo ..... 345/473
2005/0264489 A1 * 12/2005 Kojima et al. ..... 345/63
2006/0066519 A1 3/2006 Tokunaga
2006/0164343 A1 * 7/2006 Sasaki et al. ..... 345/67
2007/0097029 A1 5/2007 Yoon
2008/0111886 A1 * 5/2008 Bai ..... 348/173
2008/0174522 A1 * 7/2008 Cho et al. ..... 345/60
2009/0128542 A1 5/2009 Takeda
2011/0148951 A1 6/2011 Takeda

FOREIGN PATENT DOCUMENTS

JP 09-138668 A 5/1997
JP 9-138668 A 5/1997
JP 09138668 A 5/1997

(Continued)

OTHER PUBLICATIONS

International Search Report for International Application No. PCT/JP2008/000322, Mar. 25, 2008, Matsushita Electric Industrial Co., Ltd.

(Continued)

*Primary Examiner* — Dorothy Harris
(74) *Attorney, Agent, or Firm* — RatnerPrestia

(57) ABSTRACT

A plasma display device has a plasma display panel, an accumulative adding circuit for accumulatively adding predetermined values every predetermined unit time while current is applied to the plasma display panel, and a judging circuit for judging the property of an image to be displayed on the plasma display panel. The accumulative adding circuit varies the predetermined values in response to the judgment result of the judging circuit.

3 Claims, 12 Drawing Sheets

FOREIGN PATENT DOCUMENTS

| | | | |
|---|---|---|---|
| JP | 2000-242224 | A | 9/2000 |
| JP | 2002-366088 | A | 12/2002 |
| JP | 2002366088 | A | 12/2002 |
| JP | 2003-015590 | A | 1/2003 |
| JP | 200315590 | A | 1/2003 |
| JP | 2004-061863 | A | 2/2004 |
| JP | 2004061863 | A | 2/2004 |
| JP | 2006-091437 | A | 4/2006 |
| JP | 200691437 | A | 4/2006 |
| JP | 2007-128089 | A | 5/2007 |
| JP | 2007128089 | A | 5/2007 |
| JP | 4702367 | B2 | 6/2011 |
| WO | WO 2007/097297 | A1 | 8/2007 |

OTHER PUBLICATIONS

Chinese Office Action for 200880001621.4, Sep. 13, 2010.

* cited by examiner

FIG. 9

| Accumulative added value | Vset |
|---|---|
| Lower than 800 | 220(V) |
| Lower than 1600 | 250(V) |
| Lower than 3200 | 267(V) |
| 3200 or higher | 280(V) |

PLASMA DISPLAY DEVICE AND DRIVING METHOD OF PLASMA DISPLAY PANEL

This application is a U.S. National Phase Application of PCT International Application PCT/JP2008/000322.

TECHNICAL FIELD

The present invention relates to a plasma display device used in a wall-hanging television (TV) or a large monitor, and a driving method of a plasma display panel.

BACKGROUND ART

A typical alternating-current surface discharge type panel used as a plasma display panel (hereinafter referred to as "panel") has many discharge cells between a front plate and a back plate that are faced to each other. The front plate has the following elements:

- a plurality of display electrode pairs disposed in parallel on a front glass substrate; and
- a dielectric layer and a protective layer for covering the display electrode pairs.

Here, each display electrode pair is formed of a pair of scan electrode and sustain electrode. The back plate has the following elements:

- a plurality of data electrodes disposed in parallel on a back glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas containing xenon at a partial pressure of 5%, for example, is filled into a discharge space in the sealed product. Discharge cells are disposed in intersecting parts of the display electrode pairs and the data electrodes. In the panel having this structure, ultraviolet rays are emitted by gas discharge in each discharge cell. The ultraviolet rays excite respective phosphors of red (R), green (G), and blue (B) to emit light, and thus provide color display.

A subfield method is generally used as a method of driving the panel. In this method, one field period is divided into a plurality of subfields, and the subfields at which light is emitted are combined, thereby performing gradation display.

Each subfield has an initializing period, an address period, and a sustain period. In the initializing period, initializing discharge occurs, a wall charge required for a subsequent addressing operation is formed on each electrode, and a priming particle (excitation particle as a detonating agent for discharge) for stably causing address discharge is generated. In the address period, addressing pulse voltage is selectively applied to a discharge cell where display is to be performed to cause address discharge, thereby forming a wall charge (hereinafter, this operation is referred to as "addressing"). In the sustain period, sustain pulse voltage is alternately applied to the display electrode pairs formed of the scan electrodes and the sustain electrodes, sustain discharge is caused in the discharge cell having performed address discharge, and a phosphor layer of the corresponding discharge cell is light-emitted, thereby displaying an image.

Of the subfield method, a new driving method is disclosed where light emission that is not related to gradation display is minimized and the contrast ratio is improved. In this driving method, the initializing discharge is performed using a gradually varying voltage waveform, and the initializing discharge is selectively applied to the discharge cell having performed sustain discharge. Thus, light emission that is not related to the gradation display is minimized, and the contrast ratio is improved.

In this driving method, for example, in the initializing period of one of a plurality of subfields, an initializing operation (hereinafter referred to as "all-cell initializing operation") of causing initializing discharge in all discharge cells is performed. In the initializing period of the other subfields, an initializing operation (hereinafter referred to as "selection initializing operation") of causing initializing discharge in only a discharge cell having performed sustain discharge is performed. Thanks to this driving manner, the light emission that is not related to the image display is determined only by light emission following the discharge of the all-cell initializing operation. As a result, the luminance (hereinafter referred to as "black luminance") in a black display region is provided only by feeble light emission by the all-cell initializing operation, and an image of high contrast can be displayed. This driving method is disclosed in patent document 1, for example.

The definition and screen size of the panel have been recently increased, and hence the quality of the display image has been required to be further improved in the plasma display device. However, the discharge characteristic of the panel varies (hereinafter referred to as "variation with time") according to the accumulative time (hereinafter referred to as "current-flow accumulative time") of time when current is applied to the panel. The progress rate of the variation with time of the discharge characteristic of the panel depends on the image displayed on the panel. Therefore, it is not easy to optimize the control of stably causing discharge regardless of the current-flow accumulative time and the image displayed on the panel.

[Patent document 1] Japanese Patent Unexamined Publication No. 2000-242224

SUMMARY OF THE INVENTION

The present invention addresses the above-mentioned problems, and allows optimization of control of stably causing discharge in response to the variation with time of the discharge characteristic that progresses dependently on the current-flow accumulative time of the panel and the image displayed on the panel. The present invention provides a plasma display device and a driving method of a panel capable of improving the image display quality.

The plasma display device has the following elements:

- a plasma display panel having a plurality of discharge cells, each of the discharge cells including a display electrode pair that is formed of a scan electrode and a sustain electrode;
- a driving circuit for applying a driving voltage waveform to the display electrode pair and driving the plasma display panel;
- a current-flow accumulative time measuring circuit for measuring the accumulative time when the driving circuit drives the plasma display panel; and
- an image judging circuit for judging the property of an image to be displayed on the plasma display panel and outputting the judgment result.

The driving circuit varies the driving voltage waveform in response to the accumulative time, and controls the time interval for varying the driving voltage waveform in response to the judgment result of the image judging circuit.

In the driving method of the plasma display panel, the plasma display panel having a plurality of discharge cells, each of the discharge cells including a display electrode pair that is formed of a scan electrode and a sustain electrode is driven by varying the driving voltage waveform according to the driving accumulative time when the plasma display panel is driven. Here, a plurality of subfields having an initializing period, address period, and sustain period are disposed in one field period. The property of an image to be displayed on the plasma display panel is judged, the judgment result is output, and the variation of the driving voltage waveform is caused early in response to the judgment result.

BRIEF DESCRIPTION OF DRAWINGS

FIG. 9 is a diagram showing a relation between an output value of the accumulative adding circuit and ascent-ramp waveform voltage.

REFERENCE MARKS IN THE DRAWINGS

Figure 1:
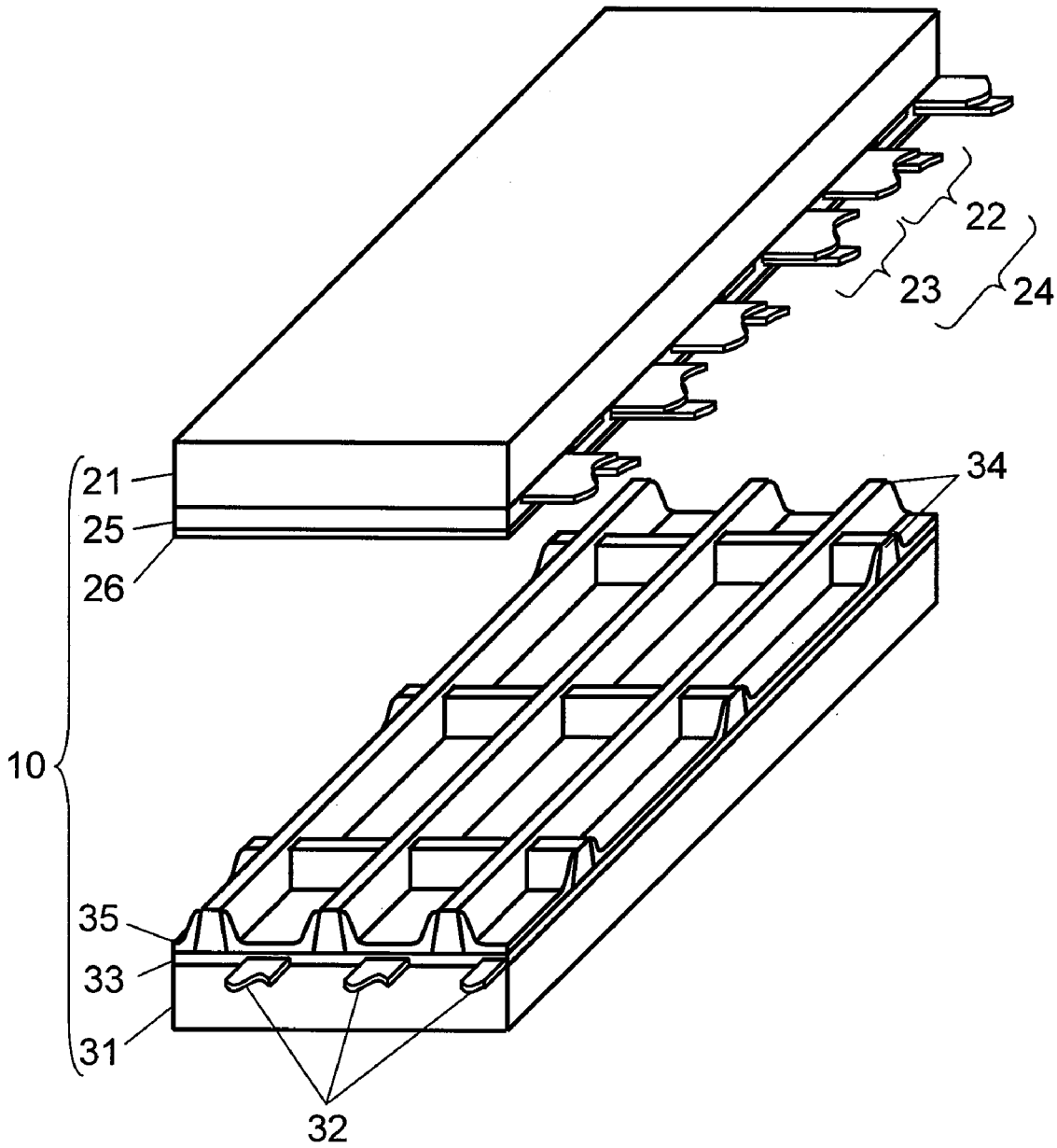
FIG. 1 is an exploded perspective view showing a structure of a panel of the present invention.

1 plasma display device
10 panel
21 front plate
22 scan electrode
23 sustain electrode
24 display electrode pair
25, 33 dielectric layer
26 protective layer
31 back plate
32 data electrode
34 barrier rib
35 phosphor layer
41 image signal processing circuit
42 data electrode driving circuit
43 scan electrode driving circuit
44 sustain electrode driving circuit
45 timing generating circuit
46 still image judging circuit
47 APL detecting circuit
48A accumulative adding circuit
48B accumulative adding circuit
49 image judging circuit
50 sustain pulse generating circuit
51 electric power recovering circuit
52 clamping circuit
53 initializing waveform generating circuit
54 scan pulse generating circuit
61 delaying circuit
62 differential circuit
63 first comparing circuit
64 first accumulative counter
65 second comparing circuit
71 timer
72 second accumulative counter
73 third comparing circuit
74 third accumulative counter
75 fourth comparing circuit
76 fourth accumulative counter
77 fifth comparing circuit
78 fifth accumulative counter
79 sixth comparing circuit
Q1, Q2, Q3, Q4, Q11, Q12, Q13, Q14, Q21, QH1-QHn, QL1-QLn switching element
C1, C10, C11, C12, C21 capacitor
R10, R11 resistor
INa, INb input terminal
D1, D2, D10, D21 diode
L1 inductor
IC1-ICn control circuit

DETAILED DESCRIPTION OF PREFERRED EMBODIMENTS

Plasma display devices in accordance with first and second exemplary embodiments of the present invention will be described hereinafter with reference to the accompanying drawings.

First Exemplary Embodiment

FIG. 1 is an exploded perspective view showing a structure of panel 10 in accordance with the first exemplary embodiment of the present invention. A plurality of display electrode pairs 24 formed of scan electrodes 22 and sustain electrodes 23 are disposed on glass-made front plate 21. Dielectric layer 25 is formed so as to cover scan electrodes 22 and sustain electrodes 23, and protective layer 26 is formed on dielectric layer 25.

Protective layer 26 is actually used as a material of the panel in order to reduce the breakdown voltage in a discharge cell. Protective layer 26 is made of material that is mainly made of MgO and has a large secondary electron discharge coefficient and high durability when neon (Ne) and xenon (Xe) gases are filled.

A plurality of data electrodes 32 are formed on back plate 31, dielectric layer 33 is formed so as to cover data electrodes 32, and mesh-like barrier ribs 34 are formed on dielectric layer 33. Phosphor layers 35 for emitting lights of respective colors of red (R), green (G), and blue (B) are formed on the side surfaces of barrier ribs 34 and on dielectric layer 33.

Front plate 21 and back plate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon, for example, as discharge gas. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may be a structure having striped barrier ribs, for example.

Figure 2:
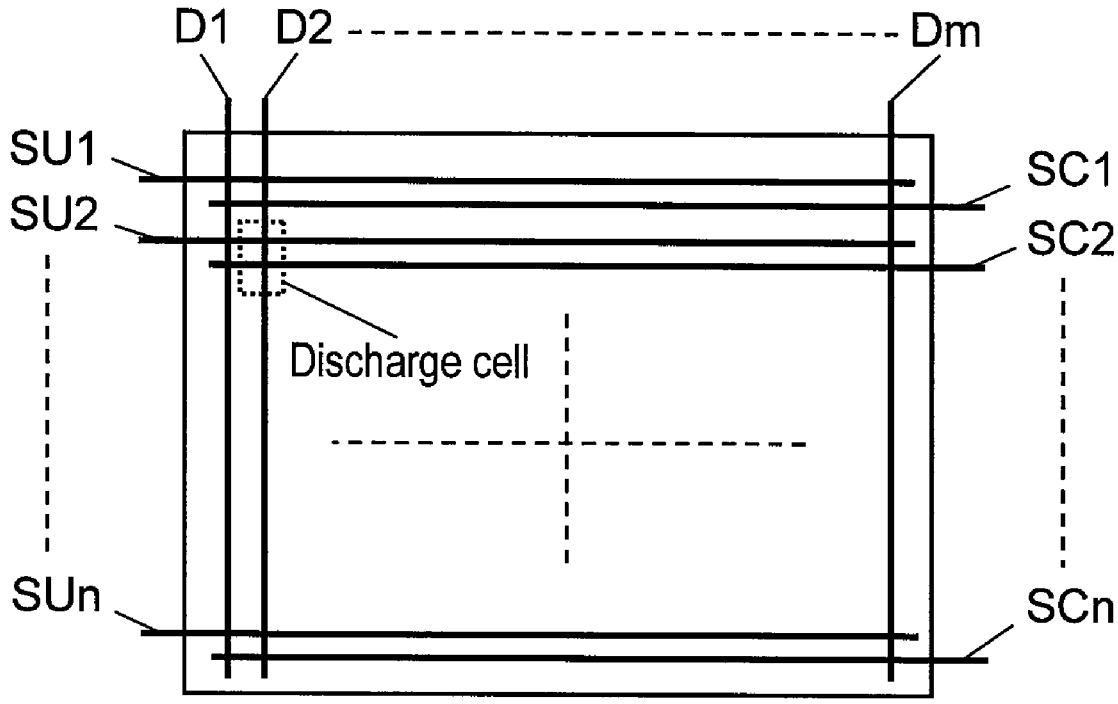
FIG. 2 is an electrode array diagram of the panel.

FIG. 2 is an electrode array diagram of panel 10 in accordance with the first exemplary embodiment of the present invention. In panel 10, n scan electrodes SC1 through SCn (scan electrodes 22 in FIG. 1) and n sustain electrodes SU1 through SUn (sustain electrodes 23 in FIG. 1) long in the column direction are arranged, and m data electrodes D1 through Dm (data electrodes 32 in FIG. 1) long in the row direction are arranged. Each discharge cell is formed in the intersecting part of a pair of scan electrode SCi (i is 1 through n) and sustain electrode SUi and one data electrode Dj (j is 1 through m), the number of formed discharge cells in the discharge space is m×n.

Next, a driving voltage waveform and its operation for driving panel 10 are described. The plasma display device of the first embodiment performs gradation display by a subfield method. In this method, one field period is divided into a plurality of subfields, and emission and non-emission of light of each display cell are controlled in each subfield. Each subfield has an initializing period, an address period, and a sustain period.

In the initializing period in each subfield, initializing discharge is performed to form a wall charge required for a subsequent address discharge on each electrode. The initializing operation has a function of reducing the discharge delay and generating a priming particle (excitation particle as a detonating agent for discharge) for stably causing the addressing discharge. The initializing operation at this time includes an all-cell initializing operation of causing initializing discharge in all discharge cells, and a selection initializing operation of causing initializing discharge in a discharge cell that has performed sustain discharge in the previous subfield.

In the address period, address discharge is selectively caused in a discharge cell to emit light in a subsequent sustain period, thereby forming a wall charge. In the sustain period, as many sustain pulses as the number proportional to luminance weight are alternately applied to display electrode pairs 24, sustain discharge is caused in the discharge cell having caused addressing discharge, thereby emitting light. The proportionality constant is called "luminance magnification".

In the first embodiment, one field is divided into 10 subfields (first SF, second SF, . . . , 10th SF), and respective subfields have luminance weights of 1, 2, 3, 6, 11, 18, 30, 44, 60 and 80, for example. The all-cell initializing operation is performed in the initializing period of the first SF, and the selection initializing operation is performed in the initializing period of each of the second SF through 10th SF. In the sustain period of each subfield, as many sustain pulses as the number derived by multiplying the luminance weight of each subfield by a predetermined luminance magnification are applied to respective display electrode pairs 24.

In the first embodiment, the number of subfields and the luminance weight of each subfield are not limited to these values, but the subfield structure may be changed based on an image signal or the like.

The plasma display device of the first embodiment has an accumulative adding circuit that accumulatively adds predetermined values every unit time (30 minutes in the first embodiment) during applying current to the panel and varies the predetermined values based on the image to be displayed on the panel, as described later in detail. The plasma display device controls a driving waveform for driving the panel in response to an output value from the accumulative adding circuit.

Thus, the plasma display device optimally performs the control of stably causing discharge and causes stable discharge in response to the variation with time of the discharge characteristic that depends on the current-flow accumulative time of the panel and the image to be displayed on the panel.

The general outline of the driving voltage waveform is firstly described, then the circuitry and detail of the plasma display device of the first embodiment are described, and then the relation between the accumulative added value and the driving voltage waveform is described.

Figure 3:
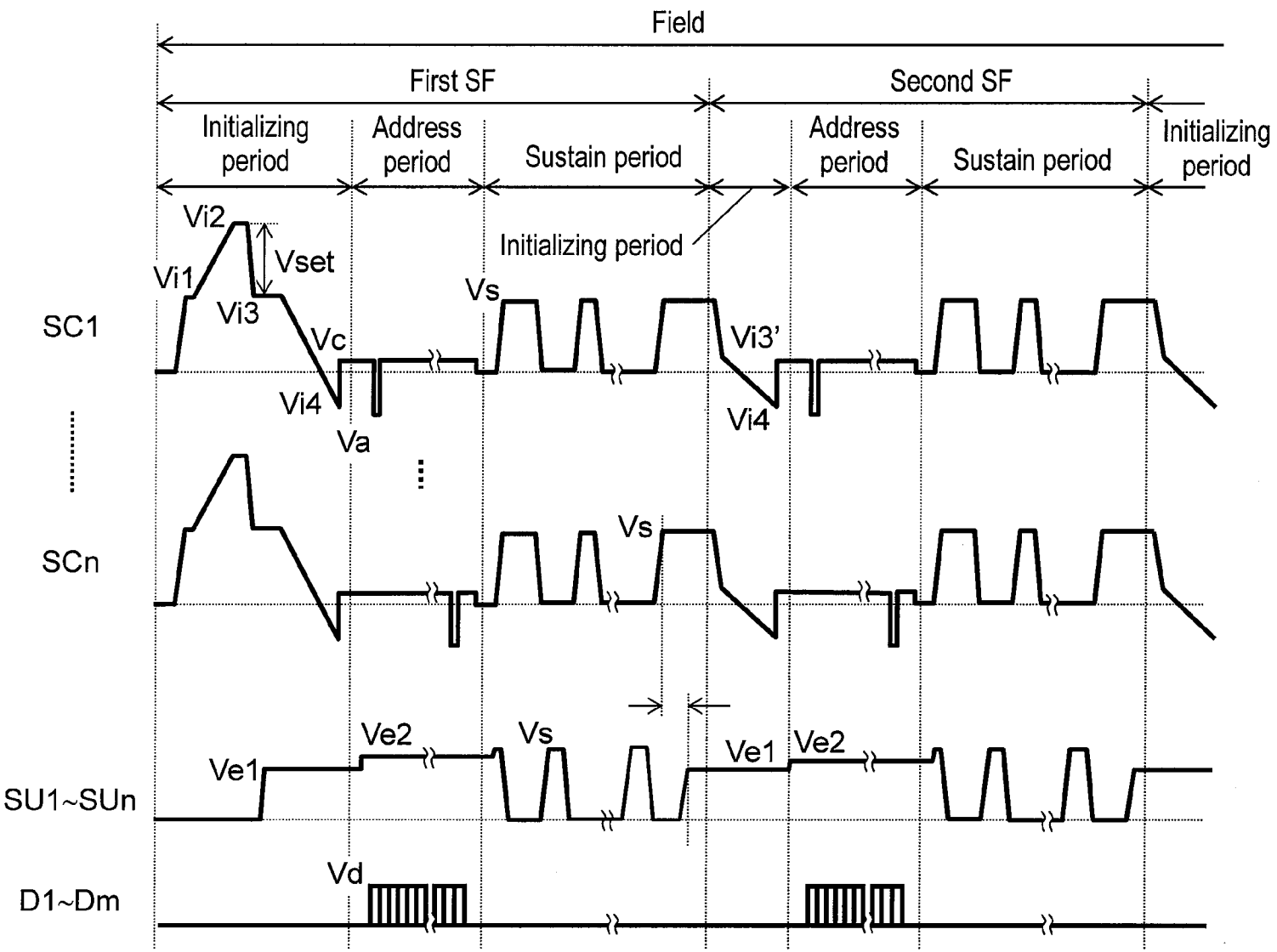
FIG. 3 is a diagram of a driving voltage waveform applied to each electrode of the panel.

FIG. 3 is a diagram of a driving voltage waveform applied to each electrode of panel 10 of the first embodiment. FIG. 3 shows the driving voltage waveforms of two subfields, namely a subfield for performing the all-cell initializing operation and a subfield for performing the selection initializing operation. The driving voltage waveforms in the other subfields are substantially the same.

In the first half of the initializing period of the first SF, 0 (V) is applied to data electrodes D1 through Dm and sustain electrodes SU1 through SUn. A ramp waveform voltage (hereinafter referred to as "ascent-ramp waveform voltage") is applied to scan electrodes SC1 through SCn. Here, the ramp waveform voltage gradually increases from voltage Vi1 that is not higher than a breakdown voltage for sustain electrodes SU1 through SUn to a voltage Vi2 that is higher than the breakdown voltage. Hereinafter, the maximum of the ascent-ramp waveform voltage applied to scan electrodes SC1 through SCn is referred to as "initializing voltage Vi2". The difference between initializing voltage Vi2 and voltage Vi1 is referred to as "Vset".

While the ascent-ramp waveform voltage increases, feeble initializing discharge continuously occurs between scan electrodes SC1 through SCn and sustain electrodes SU1 through SUn, and feeble initializing discharge continuously occurs between scan electrodes SC1 through SCn and data electrodes D1 through Dm. Negative wall voltage is accumulated on scan electrodes SC1 through SCn, and positive wall voltage is accumulated on data electrodes D1 through Dm and sustain electrodes SU1 through SUn. Here, the wall voltage on the electrodes means the voltage generated by the wall charges accumulated on the dielectric layer covering the electrodes, the protective layer, and the phosphor layer.

In the first embodiment, when the accumulative added value calculated by accumulative adding circuit 48A described later becomes a predetermined threshold or higher, initializing voltage Vi2 is increased to generate the ascent-ramp waveform voltage. This structure is described in detail later. This structure allows the stable address discharge to be caused without increasing the voltage required for causing the address discharge.

In the last half of the initializing period, positive voltage Ve1 is applied to sustain electrodes SU1 through SUn, and 0 (V) is applied to data electrodes D1 through Dm. A ramp waveform voltage (hereinafter referred to as "descent-ramp waveform voltage") is applied to scan electrodes SC1 through SCn. Here, the ramp waveform voltage gradually decreases from voltage V13 that is not higher than the breakdown voltage for sustain electrodes SU1 through SUn to voltage V14 that is higher than the breakdown voltage. While the ramp waveform voltage decreases, feeble initializing discharge continuously occurs between scan electrodes SC1 through SCn and sustain electrodes SU1 through SUn, and feeble initializing discharge continuously occurs between scan electrodes SC1 through SCn and data electrodes D1 through Dm. The negative wall voltage on scan electrodes SC1 through SCn and the positive wall voltage on sustain electrodes SU1 through SUn are reduced, positive wall voltage on data electrodes D1 through Dm is adjusted to a value suitable for the addressing operation. Thus, the all-cell initializing operation of applying initializing discharge to all discharge cells is completed.

As shown in the initializing period of the second SF in FIG. 3, the driving voltage waveform where the first half of the initializing period is omitted may be applied to each electrode. In other words, voltage Ve1 is applied to sustain electrodes SU1 through SUn, 0 (V) is applied to data electrodes D1 through Dm, and a descent-ramp waveform voltage gradually decreasing from voltage V13' to voltage V14 is applied to scan electrodes SC1 through SCn. Thus, in the discharge cell that has caused the sustain discharge in the sustain period of the previous subfield, feeble initializing discharge occurs, and the wall voltage on scan electrode SCi and sustain electrode SUi is reduced. In the discharge cell where sufficient positive wall voltage is accumulated on data electrode Dk (k is 1 through m) by the next previous sustain discharge, the wall voltage is discharged by the excessive amount to be adjusted to be appropriate for the addressing operation. While, in the discharge cell that has not caused the sustain discharge in the previous subfield, discharge is not performed and the wall charge at the completion of the initializing period of the previous subfield is kept. Such initializing operation having no first half is a selection initializing operation where initializing discharge is performed in the discharge cell in which a sustain operation is performed in the sustain period of the next previous subfield.

In the subsequent address period, voltage Ve2 is applied to sustain electrodes SU1 through SUn, and voltage Vc is applied to scan electrodes SC1 through SCn.

First, negative scan pulse voltage Va is applied to scan electrode SC1 in the first column, positive addressing pulse voltage Vd is applied to data electrode Dk (k is 1 through m), of data electrodes D1 through Dm, in the discharge cell to be made to light up in the first column. The voltage difference in the intersecting part of data electrode Dk and scan electrode SC1 is derived by adding the difference between the wall voltage on data electrode Dk and that on scan electrode SC1 to the difference (Vd−Va) of the external applied voltage, and exceeds the breakdown voltage. Address discharge occurs between data electrode Dk and scan electrode SC1 and between sustain electrode SU1 and scan electrode SC1. Positive wall voltage is accumulated on scan electrode SC1, negative wall voltage is accumulated on sustain electrode SU1, and negative wall voltage is also accumulated on data electrode Dk.

Thus, an addressing operation is performed that causes address discharge in the discharge cell to be made to light up in the first column and accumulates wall voltage on each electrode. The voltage in the intersecting parts of scan electrode SC1 and data electrodes D1 through Dm to which addressing pulse voltage Vd is not applied does not exceed the breakdown voltage, so that address discharge does not occur. This addressing operation is repeated up to the discharge cell in the n-th column, and the address period is completed.

In the subsequent sustain period, positive sustain pulse voltage Vs is firstly applied to scan electrodes SC1 through SCn, and 0 (V) is applied to sustain electrodes SU1 through SUn. In the discharge cell having caused the address discharge, the voltage difference between scan electrode SCi and sustain electrode SUi is obtained by adding the difference between the wall voltage on scan electrode SCi and that on sustain electrode SUi to sustain pulse voltage Vs, and exceeds the breakdown voltage.

Sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell where address discharge has not occurred in the address period, sustain discharge does not occur, and the wall voltage at the completion of the initializing period is kept.

Subsequently, 0 (V) is applied to scan electrodes SC1 through SCn, and sustain pulse voltage Vs is applied to sustain electrodes SU1 through SUn. In the discharge cell having caused the sustain discharge, the voltage difference between sustain electrode SUi and scan electrode SCi exceeds the breakdown voltage. Therefore, sustain discharge occurs between sustain electrode SUi and scan electrode SCi again, negative wall voltage is accumulated on sustain electrode SUi, and positive wall voltage is accumulated on scan electrode SCi. Hereinafter, similarly, as many sustain pulses as the number derived by multiplying the luminance weight by luminance magnification are alternately applied to scan electrodes SC1 through SCn and sustain electrodes SU1 through SUn, and potential difference is caused between the electrodes of the display electrode pairs 24. Thus, sustain discharge in the discharge cell that has caused the address discharge in the address period occurs continuously.

At the end of the sustain period, after a predetermined time after voltage Vs for causing final sustain discharge is applied to scan electrodes SC1 through SCn, voltage Ve1 for reducing the discharge is applied to sustain electrodes SU1 through SUn. Thus, so called narrow pulse-like voltage difference is applied between scan electrodes SC1 through SCn and sustain electrodes SU1 through SUn, and a part or the whole of wall voltage on scan electrode SCi and sustain electrode SUi is eliminated in the state where positive wall voltage is left on data electrode Dk (hereinafter this discharge is referred to as "erasing discharge").

After a predetermined time interval after voltage Vs for causing final sustain discharge, namely erasing discharge, is applied to scan electrodes SC1 through SCn, voltage Ve1 for reducing the potential between electrodes of display electrode pair 24 is applied to sustain electrodes SU1 through SUn. Thus, the sustain operation in the sustain period is completed.

The operation in the subsequent subfield is substantially the same as the above-mentioned operation except for the number of sustain pulses in the sustain period, so that the description of it is omitted. The general outline of the driving voltage waveform to be applied to each electrode of panel 10 of the first embodiment has been described.

Figure 4:
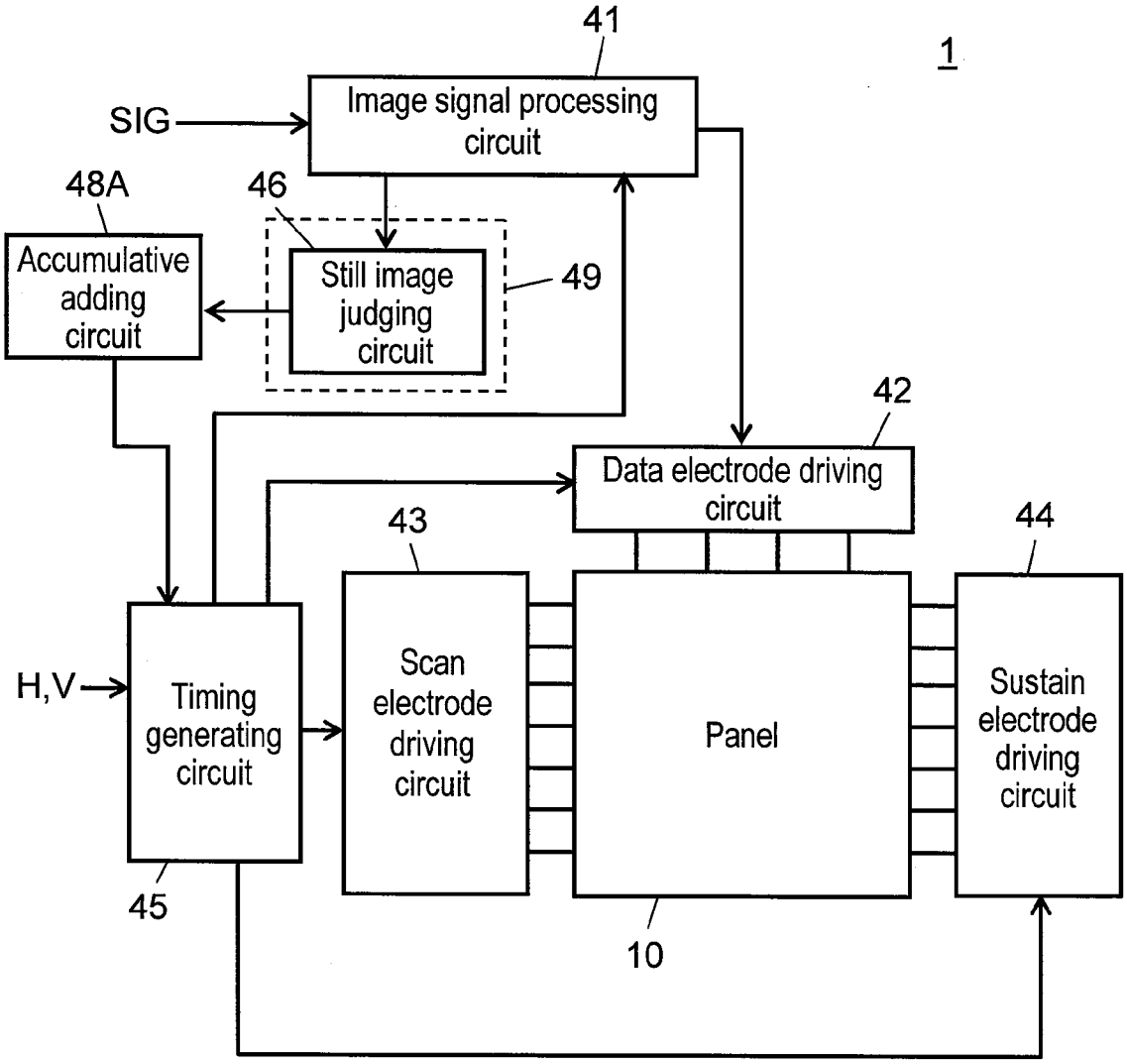
FIG. 4 is a circuit block diagram of a plasma display device in accordance with a first exemplary embodiment of the present invention.

Next, a structure of the plasma display device of the first embodiment is described. FIG. 4 is a circuit block diagram of the plasma display device of the first embodiment. Plasma display device 1 has the following elements:

- panel 10;
- image signal processing circuit 41;
- data electrode driving circuit 42;
- scan electrode driving circuit 43;
- sustain electrode driving circuit 44;
- timing generating circuit 45;
- still image judging circuit 46;
- accumulative adding circuit 48A; and
- a power supply circuit (not shown) for supplying power required for each circuit block.

Still image judging circuit 46 is an example of image judging circuit 49 for judging the property of an image to be displayed on the panel and outputting a judgment result. In the first embodiment, the property of the image means the property of a still image, for example.

Image signal processing circuit 41 converts input image signal SIG into image data that indicates emission or non-emission of light in each subfield. Data electrode driving circuit 42 converts the image data of each subfield into a signal corresponding to each of data electrodes D1 through Dm, and drives each of data electrodes D1 through Dm.

Still image judging circuit 46 judges whether the image to be displayed on panel 10 is a still image, and outputs the judgment result.

Accumulative adding circuit 48A performs accumulative addition of adding and increasing predetermined values every unit time (30 minutes in the first embodiment) while each driving circuit drives panel 10, namely while current is applied to panel 10. The accumulative addition result is not reset, but is increased with the current-flow accumulative time of the panel. Therefore, accumulative adding circuit 48A has a function as a current-flow accumulative time measuring circuit for measuring the accumulative time when each driving circuit drives panel 10. At this time, accumulative adding circuit 48A determines the ratio of the display period of the still image to the unit time based on the output from still image judging circuit 46, and, when the ratio is large, increases the predetermined value and performs accumulative addition. Accumulative adding circuit 48A compares the accumulative added value with a predetermined threshold, and, when the accumulative addition result becomes the threshold or higher, outputs a signal showing the fact to timing generating circuit 45.

Timing generating circuit 45 generates various timing signals for controlling the operation of each circuit block based on horizontal synchronizing signal H, vertical synchronizing signal V, and the output from accumulative adding circuit 48A, and supplies them to respective circuit blocks. In the first embodiment, as discussed above, timing generating circuit 45 controls the voltage value of initializing voltage Vi2 of the ascent-ramp waveform voltage based on the accumulative added value of accumulative adding circuit 48A, and outputs a corresponding timing signal to scan electrode driving circuit 43. Here, the ascent-ramp waveform voltage is to be applied to scan electrodes SC1 through SCn in the initializing period.

Scan electrode driving circuit 43 has an initializing waveform generating circuit, a sustain pulse generating circuit, and a scan pulse generating circuit, and drives each of scan electrodes SC1 through SCn based on the timing signal. The initializing waveform generating circuit generates the initializing waveform voltage to be applied to scan electrodes SC1 through SCn in the initializing period. The sustain pulse generating circuit generates sustain pulse voltage to be applied to scan electrodes SC1 through SCn in the sustain period. The scan pulse generating circuit generates scan pulse voltage to be applied to scan electrodes SC1 through SCn in the address period. Sustain electrode driving circuit 44 has a sustain pulse generating circuit and a circuit for generating voltage Ve1 and voltage Ve2, and drives sustain electrodes SU1 through SUn based on the timing signal. The circuitry of the plasma display device of the first embodiment has been described.

Figure 5:
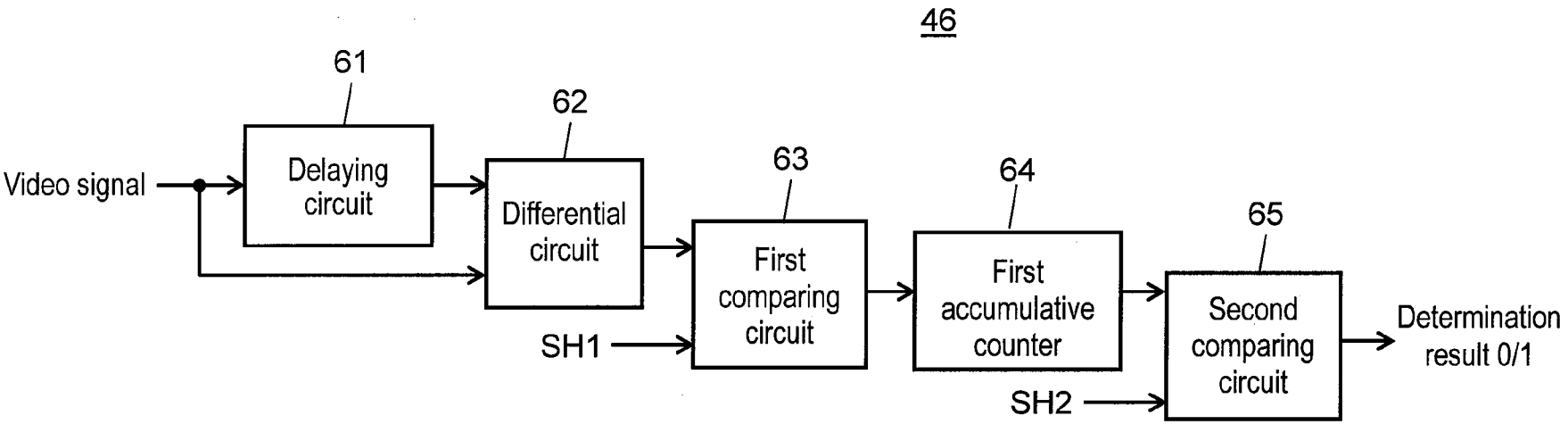
FIG. 5 is a circuit block diagram of a still image judging circuit in accordance with the first exemplary embodiment.

Next, a configuration of still image judging circuit 46 is described. FIG. 5 is a circuit block diagram of the still image judging circuit of the first embodiment. Still image judging circuit 46 has delaying circuit 61, differential circuit 62, first comparing circuit 63, second comparing circuit 65, and first accumulative counter 64.

Delaying circuit 61 is so called frame memory that is formed of a semiconductor storage cell that can write and read data and is generally called a random access memory (RAM), and can delay a video signal by one frame period. Delaying circuit 61 outputs the video signal input from image signal processing circuit 41 with delay by one frame period.

Differential circuit 62 calculates the absolute value of the difference between the video signal (video signal input in delaying circuit 61) of the present frame and the video signal of the previous frame output from delaying circuit 61. Differential circuit 62 thus detects the variation amount (variation in light emission luminance) between one frame and its previous frame in the same pixel.

First comparing circuit 63 compares the output value from differential circuit 62 with predetermined still image judging threshold SH1. First comparing circuit 63 outputs "1" when it judges that the output value from differential circuit 62 is still image judging threshold SH1 or higher, namely the light emission luminance varies between one frame and its previous frame in the pixel. First comparing circuit 63 outputs "0" when it judges that the output value from differential circuit 62 is lower than still image judging threshold SH1, namely the light emission luminance does not vary between one frame and its previous frame in the pixel. Still image judging threshold SH1 is preferably set in consideration of the noise and maximum gradation value, and is set at "10" in the first embodiment. However, this value is just one example, and may be set optimally in response to the specification of the plasma display device or the characteristic of the panel.

First accumulative counter 64 accumulatively adds the outputs from first comparing circuit 63 over one frame period. First accumulative counter 64 therefore outputs the total added value between one frame and its previous frame of the outputs from first comparing circuit 63, namely the number of pixels where it is judged that the light emission luminance varies between one frame and its previous frame. For instance, when it is judged that the luminance does not vary in any pixel, first accumulative counter 64 outputs the minimum value "0". When it is judged that the luminance varies in all pixels, first accumulative counter 64 outputs the value (about 2,000,000 in the present embodiment) equal to the total number of pixels as the maximum value. This accumulative added value is reset frame-by-frame so as to prevent addition for a plurality of frames.

Second comparing circuit 65 compares the output value from first accumulative counter 64 with predetermined still image judging threshold SH2, and judges whether the display image is a still image. When the output value from first accumulative counter 64 is lower than still image judging threshold SH2, second comparing circuit 65 judges that the display image is a still image, and outputs "1". When the output value from first accumulative counter 64 is still image judging threshold SH2 or higher, second comparing circuit 65 judges that the display image is not a still image, namely the display image is a moving image, and outputs "0". Therefore, still image judging circuit 46 outputs "1" once per frame when the display image is a still image, or "0" once per frame when it is a moving image. Still image judging threshold SH2 is preferably set in consideration of the noise and the total number of pixels, and is set at "10000" when the total number of pixels is about 2,000,000 in the first embodiment. However, this value is just one example, and may be set optimally in response to the specification of the plasma display device or the characteristic of the panel.

This configuration of still image judging circuit 46 is just one example, and the present invention is not limited to this configuration. For example, the following configuration (not shown) may be employed. First accumulative counter 64 accumulatively adds the outputs from differential circuit 62 without first comparing circuit 63, and second comparing circuit 65 compares the total added value between one frame and its previous frame with the still image judging threshold (this threshold is different from still image judging threshold SH2 of FIG. 5) and judges whether the display image is a still image. Alternatively, a generally known configuration capable of judging a still image may be employed. The above-mentioned video signal is not limited to a video signal of a specific form, but may be an RGB signal, a YUV signal, or a video signal of any other form. Still image judging circuit 46 may have an optimal configuration in response to the employed video signal form. For example, the case where an RGB signal is employed as the video signal is described. The above-mentioned circuit is disposed for each RGB signal, the still image judgment is performed for each RGB signal, and the display image is judged as a still image when the display image is judged as the still image for all RGB signals. Thus, the still image judgment is allowed.

Figure 6:
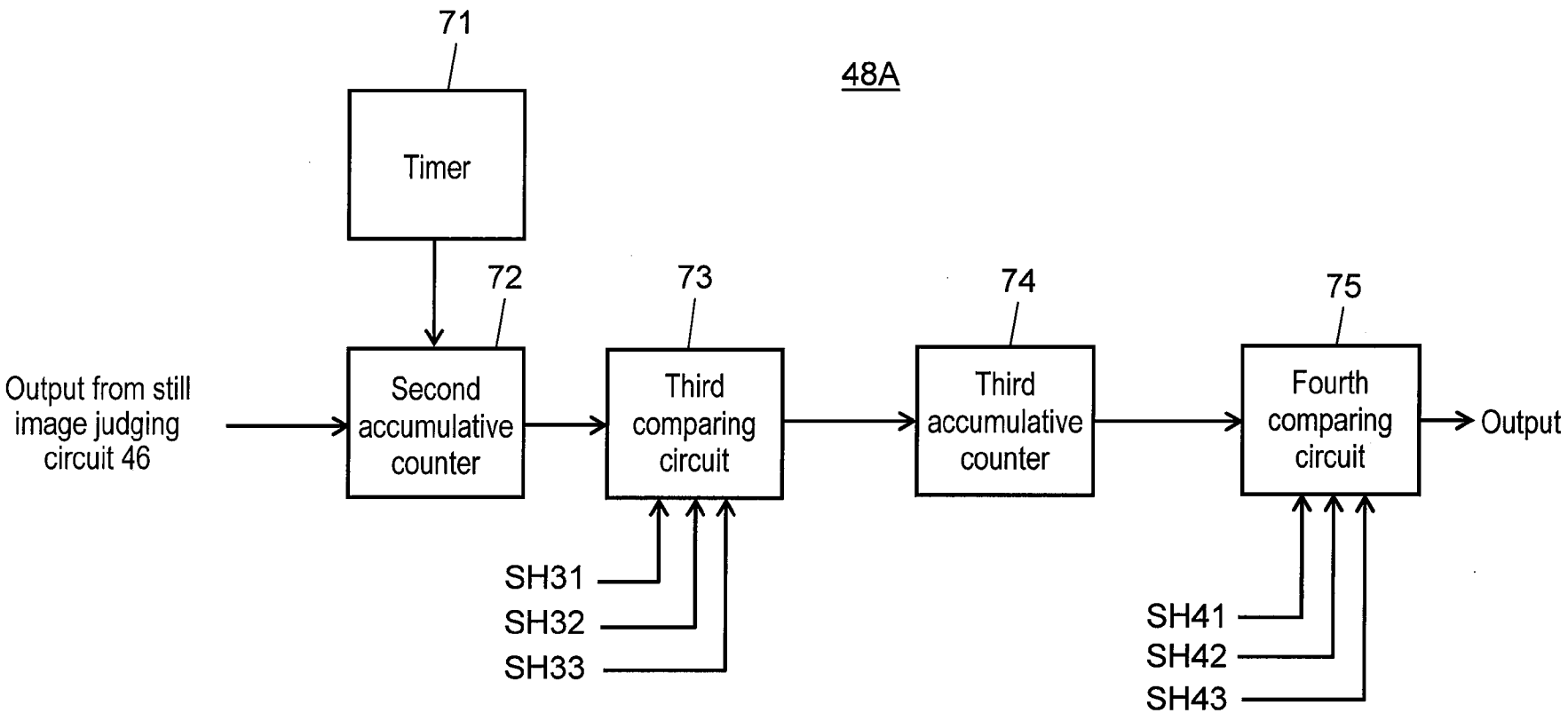
FIG. 6 is a circuit block diagram of an accumulative adding circuit in accordance with the first exemplary embodiment.

Next, the configuration of accumulative adding circuit 48A is described. FIG. 6 is a circuit block diagram of accumulative adding circuit 48A of the first embodiment. Accumulative adding circuit 48A has timer 71, second accumulative counter 72, third accumulative counter 74, third comparing circuit 73, and fourth comparing circuit 75.

Timer 71 has a generally known timer function of counting time. Timer 71 performs a timer operation while current is applied to panel 10, counts time in the unit time (here, 30 minutes) in the first embodiment, and outputs a signal indicating a lapse of the unit time whenever the unit time passes.

Second accumulative counter 72 operates in response to an output from still image judging circuit 46 and an output from timer 71, and accumulatively adds the output values from still image judging circuit 46 for the unit time (30 minutes). Every unit time, second accumulative counter 72 outputs the total added value in each unit time. Therefore, second accumulative counter 72 outputs a numerical value corresponding to the period when the still image is displayed in the unit time (30 minutes). For example, when a moving image is displayed in the whole unit time (30 minutes), second accumulative counter 72 outputs the minimum value "0". When a still image is displayed in the whole unit time (30 minutes), second accumulative counter 72 outputs the maximum value "54000". Here, this maximum value varies dependently on the video signal, and this "54000" is an example of the video signal of 30 frames/second, namely 30 frames×60 seconds×30 minutes=54000. This accumulative added value is reset every unit time so as to prevent addition for a plurality of unit times. The accumulative addition corresponding to the total number of frames in the unit time is not required, but the maximum value may be reduced by performing thinning out during the accumulative addition.

Third comparing circuit 73 compares the output value from second accumulative counter 72 with a predetermined threshold, judges, every unit time, the ratio of the display period of the still image to the unit time, and outputs a predetermined value corresponding to the ratio. Third comparing circuit 73 judges the ratio of the display period of the still image to the unit time by classifying it into four stages, and outputs one of numerical values "1" through "4" in response to the judgment result. Therefore, the comparison is performed using three thresholds, namely first still-image-period judging threshold SH31, second still-image-period judging threshold SH32, and third still-image-period judging threshold SH33.

Specifically, the still image display period is divided into four stages, namely shorter than 6 minutes, 6 minutes or longer and shorter than 16 minutes, 16 minutes or longer and shorter than 26 minutes, and 26 minutes or longer. For the judgment, first still-image-period judging threshold SH31 is "10800" (30 frames×60 seconds×6 minutes=10800) corresponding to 6 minutes, second still-image-period judging threshold SH32 is "28800" (30 frames×60 seconds×16 minutes=28800) corresponding to 16 minutes, and third still-image-period judging threshold SH33 is "46800" (30 frames×60 seconds×26 minutes=46800) corresponding to 26 minutes.

Third comparing circuit 73 outputs a predetermined value every unit time (30 minutes), namely "1" when the still image display period in the unit time (30 minutes) is shorter than 6 minutes, "2" when 6 minutes or longer and shorter than 16 minutes, "3" when 16 minutes or longer and shorter than 26 minutes, or "4" when 26 minutes or longer. When a moving image is always displayed on panel 10, third comparing circuit 73 always outputs "1". When a still image is always displayed on panel 10, third comparing circuit 73 always outputs "4". When a moving image and a still image are alternately displayed on panel 10, as in receiving of usual television broadcasting, third comparing circuit 73 outputs one of "1" through "4" corresponding to the display image. Each of these thresholds is one example based on the video signal of 30 frames/second, and may be optimally set in response to the type of the video signal, the specification of the plasma display device, or the characteristic of the panel. The number of the thresholds is not limited to three, but may be four or more, or two or less.

Third accumulative counter 74 accumulatively adds predetermined values output from third comparing circuit 73 without resetting. Third accumulative counter 74 outputs the total added value of the predetermined values output from third comparing circuit 73 since the initial time of use of the plasma display device. Therefore, the numerical value output from third accumulative counter 74 increases with the current-flow accumulative time of panel 10, the rate of the increase is affected by the period when a still image is displayed on panel 10.

Fourth comparing circuit 75 compares the output value from third accumulative counter 74 with a predetermined threshold, and outputs a signal showing the result to timing generating circuit 45. Fourth comparing circuit 75 judges the output value from third accumulative counter 74 by classifying it into four stages. Therefore, the comparison is performed using three thresholds, namely first accumulative addition threshold SH41, second accumulative addition threshold SH42, and third accumulative addition threshold SH43.

In the first embodiment, first accumulative addition threshold SH41 is "800" (predetermined value "1"×1 hour/unit time of 30 minutes×400 hours=800) corresponding to current-flow accumulative time of 400 hours when a moving image is always displayed on panel 10, second accumulative addition threshold SH42 is "1600" ("1"×2×800 hours=1600) corresponding to current-flow accumulative time of 800 hours, and third accumulative addition threshold SH43 is "3200" ("1"×2×1600 hours=3200) corresponding to current-flow accumulative time of 1600 hours. Each of these thresholds is one example, and may be optimally set in response to the specification of the plasma display device or the characteristic of the panel. The number of the thresholds is not limited to three, but may be four or more, or two or less.

Accumulative adding circuit 48A may stop after the accumulative added value exceeds the third accumulative addition threshold having the highest value.

Figure 7:
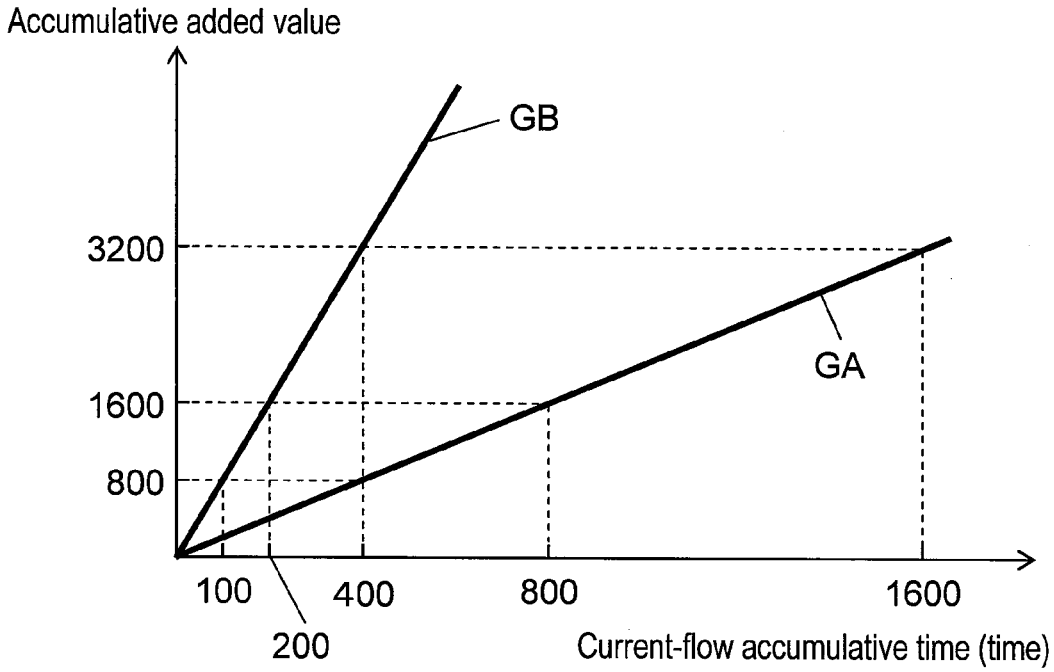
FIG. 7 is a diagram illustrating an operation of the accumulative adding circuit of the present invention.

Accumulative adding circuit 48A is further described in accordance with FIG. 7. FIG. 7 is a diagram illustrating the operation of accumulative adding circuit 48A of the first embodiment. In FIG. 7, the horizontal axis shows the current-flow accumulative time of panel 10, and the vertical axis shows the accumulative added value as the output from third accumulative counter 74 in accumulative adding circuit 48A.

For example, when a moving image is always displayed on panel 10, third comparing circuit 73 always outputs "1". Therefore, the output value of third accumulative counter 74 gradually increases proportionally to the current-flow accumulative time of panel 10 as shown by graph GA of FIG. 7. When a still image is always displayed on panel 10, third comparing circuit 73 always outputs "4". Therefore, the output value of third accumulative counter 74 increases at a gradient four times that of graph GA, as shown by graph GB of FIG. 7.

Therefore, in graph GA showing the case that the moving image is always displayed on panel 10, the output value of third accumulative counter 74 becomes equal to "800" as first accumulative addition threshold SH41 when the current-flow accumulative time reaches 400 hours. In graph GB showing the case that the still image is always displayed on panel 10, the output value of third accumulative counter 74 becomes equal to "800" as first accumulative addition threshold SH41 when the current-flow accumulative time reaches 100 hours. In graph GB, the output value becomes first accumulative addition threshold SH41 in a time one-fourth of that of graph GA. In graph GB showing the case that the still image is always displayed on panel 10, output value reaches second accumulative addition threshold SH42 "1600" or third accumulative addition threshold SH43 "3200" in a time one-fourth of that of graph GA, similarly.

The longer the display period of the still image on panel 10, the earlier the output value of third accumulative counter 74 reaches each accumulative addition threshold. In the first embodiment, accumulative adding circuit 48A has such a configuration for the following reason.

The discharge characteristic depends on the current-flow accumulative time of panel 10, and a factor such as discharge delay or dark current for making the discharge unstable depends on the current-flow accumulative time of panel 10. The discharge delay means a time delay after the voltage for causing discharge is applied to a discharge cell and until the discharge occurs actually. The dark current means the current occurring in the discharge cell regardless of the discharge. Therefore, applied voltage required for stably causing the discharge also depends on the current-flow accumulative time of panel 10.

Figure 8:
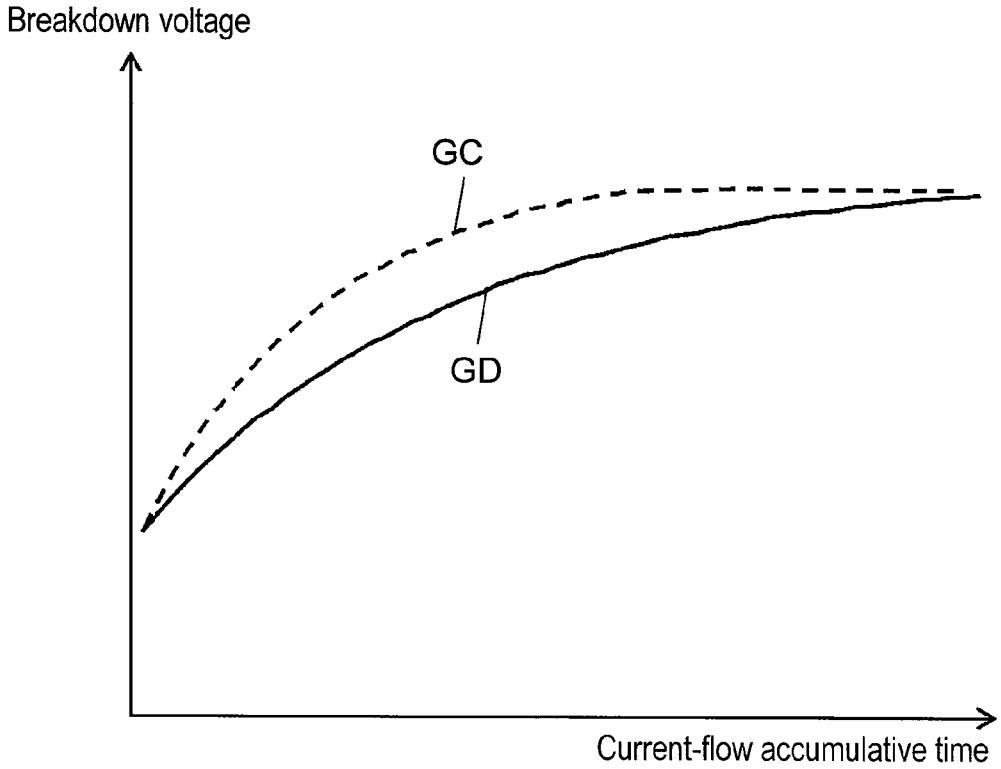
FIG. 8 is a pattern diagram showing a relation between current-flow accumulative time and breakdown voltage of the panel.

FIG. 8 is a pattern diagram showing a relation between the current-flow accumulative time and breakdown voltage of the panel. The horizontal axis shows the current-flow accumulative time of the panel, and the vertical axis shows the breakdown voltage. In FIG. 8, as the current-flow accumulative time of the panel becomes longer, the breakdown voltage gradually increases.

In FIG. 8, graph GC shown by a broken line shows the case that the display of a still image continues for a long time, and graph GD shown by a solid line shows the case that a moving image is displayed. When graph GC showing the case that the display of the still image on panel 10 continues for a long time is compared with graph GD showing the case that the moving image is displayed on panel 10, the variation with time of the discharge characteristic progresses rapidly in the case that the display of the still image continues for a long time, as shown in FIG. 8. The discharge characteristic of panel 10 depends on the state of the discharge gas filled into it. Therefore, it is preferable that the discharge gas is homogeneous as much as possible. When the display of the still image continues for a long time, however, the discharge gas slightly moves near the boundary between the region of high light emission luminance and the region of low light emission luminance to cause deviation in distribution. This deviation is considered to cause the rapid progression.

Therefore, in the first embodiment, the current-flow accumulative time of panel 10 is not measured, but the accumulative added value is calculated that increases with the current-flow accumulative time of panel 10 at an increasing rate depending on the image to be displayed on panel 10.

In other words, the plasma display device of the first embodiment has still image judging circuit 46 and accumulative adding circuit 48A. Accumulative adding circuit 48A outputs numerical values varied based on the ratio of the display period of the still image to the unit time from third comparing circuit 73, and accumulatively adds the numerical values with third accumulative counter 74. Thanks to this configuration, accumulative adding circuit 48A can perform not a simple timer operation of periodically, accumulatively adding certain values but a accumulative addition where added value depends on the length of the display period of the still image.

Thus, even when the still image is displayed on panel 10 for a long time and the progress rate of the variation with time of the discharge characteristic is increased, a accumulative added value can be calculated that the increment varies in response to the display period of the still image. Therefore, controlling the driving waveform based on the accumulative added value allows optimal control of stably causing the discharge in response to the variation with time.

The control of the driving voltage waveform of the first embodiment is described. FIG. 9 is a diagram showing a relation between an output value of accumulative adding circuit 48A and the ascent-ramp waveform voltage in the first embodiment.

As discussed above, the discharge characteristic varies with time, and the breakdown voltage gradually increases as the current-flow accumulative time of panel 10 increases. When initializing voltage Vi2 is set with reference to the breakdown voltage of panel 10 having a short current-flow accumulative time, therefore, the breakdown voltage increases with increase in current-flow accumulative time, and hence initializing voltage Vi2 decreases relatively to the breakdown voltage. In this case, initializing discharge can become insufficient, sufficient wall voltage cannot be produced, priming can become insufficient, subsequent wiring discharge can become unstable, or the display quality of the image can degrade. Inversely, when initializing voltage Vi2 is previously set high in consideration of the variation with time of the discharge characteristic, the initializing discharge becomes strong beyond necessity in panel 10 of short current-flow accumulative time. As a result, light emission that is not related to the image display can become strong, the black luminance can increase, and the contrast can be reduced.

In other words, by increasing initializing voltage Vi2 in response to the increase in breakdown voltage following variation with time of the discharge characteristic, stable image display of high contrast is allowed regardless of the current-flow accumulative time.

In the first embodiment, initializing voltage Vi2 of the ascent-ramp waveform voltage in the all-cell initializing operation is controlled based on the comparison of the accumulative added value in accumulative adding circuit 48A with first accumulative addition threshold SH41 through third accumulative addition threshold SH43. Thus, stable address discharge is achieved.

Specifically, as shown in FIG. 9, when the accumulative added value in accumulative adding circuit 48A is lower than first accumulative addition threshold SH41 "800", Vset as the difference between initializing voltage Vi2 and voltage Vi1 is set at 220 (V). When the accumulative added value is first accumulative addition threshold SH41 "800" or higher and is lower than second accumulative addition threshold SH42 "1600", Vset is set at 250 (V). When the accumulative added value is second accumulative addition threshold SH42 "1600" or higher and is lower than third accumulative addition threshold SH43 "3200", Vset is set at 267 (V). When the accumulative added value is third accumulative addition threshold SH43 "3200" or higher, Vset is set at 280 (V). The driving waveform is optimally controlled according to the current-flow accumulative time of the panel and the display period of the still image displayed on the panel, and stable address discharge is achieved.

Each voltage value of Vset is just one example, and may be optimally set in response to the specification of the plasma display device or the characteristic of the panel.

Figure 10:
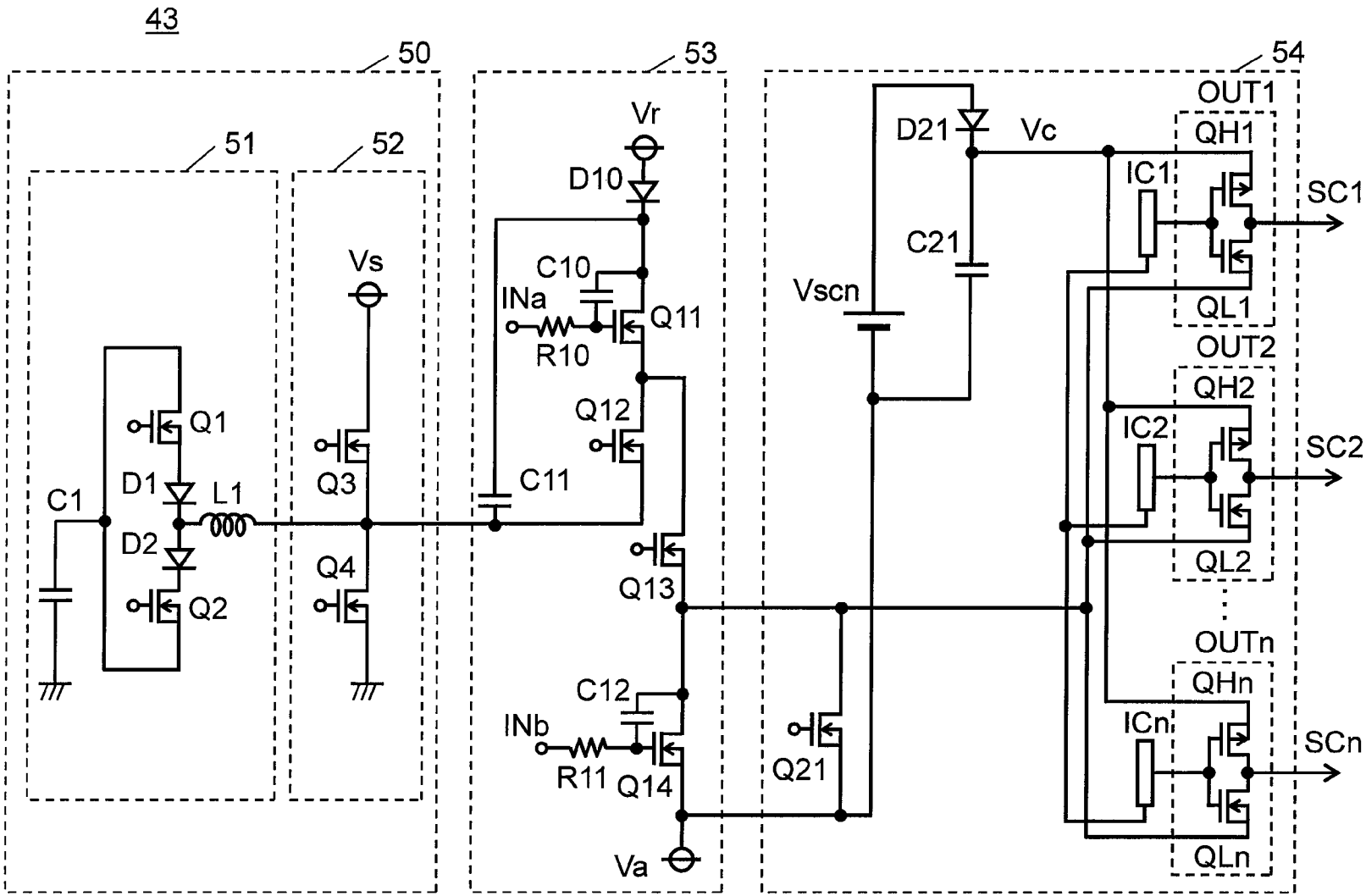
FIG. 10 is a circuit diagram of a scan electrode driving circuit of the present invention.

Next, the circuitry of scan electrode driving circuit 43 and its operation are described. FIG. 10 is a circuit diagram of scan electrode driving circuit 43 of the first embodiment of the present invention. Scan electrode driving circuit 43 has the following elements:

sustain pulse generating circuit 50 for generating a sustain pulse;

initializing waveform generating circuit 53 for generating an initializing waveform; and scan pulse generating circuit 54 for generating a scan pulse.

Sustain pulse generating circuit 50 has electric power recovering circuit 51 and clamping circuit 52. Electric power recovering circuit 51 has capacitor C1 for recovering electric power, switching element Q1, switching element Q2, diode D1 for preventing back flow, diode D2 for preventing back flow, and inductor L1 for resonance. Capacitor C1 for recovering electric power has a capacity sufficiently larger than inter-electrode capacity Cp, and is charged up to about Vs/2, namely a half of voltage value Vs, so as to work as the power supply of electric power recovering circuit 51. Clamping circuit 52 has switching element Q3 for clamping scan electrodes SC1 through SCn on voltage Vs, and switching element Q4 for clamping scan electrodes SC1 through SCn on 0 (V). Clamping circuit 52 changes each switching element based on the timing signal output from timing generating circuit 45, and generates sustain pulse voltage Vs.

Initializing waveform generating circuit 53 has two Miller integrating circuits and two separating circuits. The first Miller integrating circuit has switching element Q11, capacitor C10, and resistor R10, and generates ascent-ramp waveform voltage gradually increasing like a ramp up to initializing voltage Vi2. The second Miller integrating circuit has switching element Q14, capacitor C12, and resistor R11, and generates descent-ramp waveform voltage gradually decreasing like a ramp to predetermined voltage V14. The first separating circuit employs switching element Q12, and the second separating circuit employs switching element Q13. Initializing waveform generating circuit 53 generates the above-mentioned initializing waveform based on the timing signal output from timing generating circuit 45, and controls initializing voltage Vi2 in the all-cell initializing operation. FIG. 10 shows respective input terminals of Miller integrating circuits as input terminal INa and input terminal INb. The operation of initializing waveform generating circuit 53 is described later in detail.

Scan pulse generating circuit 54 has switching circuits OUT1 through OUTn, switching element Q21, control circuits IC1 through ICn, diode D21, and capacitor C21. Switching circuits OUT1 through OUTn output scan pulse voltage to scan electrodes SC1 through SCn, respectively. Switching element Q21 is an element for clamping the low voltage side of switching circuits OUT1 through OUTn on voltage Va. Control circuits IC1 through ICn control switching circuits OUT1 through OUTn. Diode D21 and capacitor C21 apply voltage Vc obtained by superimposing voltage Vscn on voltage Va to the high voltage side of switching circuits OUT1 through OUTn. Switching circuits OUT1 through OUTn have switching element QH1 through QHn for outputting voltage Vc, and switching element QL1 through QLn for outputting voltage Va. Scan pulse generating circuit 54, based on the timing signal supplied from timing generating circuit 45, sequentially generates scan pulse voltage Va to be applied to scan electrodes SC1 through SCn in the address period. Scan pulse generating circuit 54 outputs the voltage waveform of initializing waveform generating circuit 53 in the initializing period, or the voltage waveform of sustain pulse generating circuit 50 in the sustain period as it is.

Extremely large current flows through switching element Q3, switching element Q4, switching element Q12, and switching element Q13. These switching elements are formed by interconnecting a plurality of field effect transistors (FETs) and insulated gate bipolar transistors (IGBTs) in parallel, and reduce the impedance.

The sustain pulse generating circuit of sustain electrode driving circuit 44 has a configuration similar to that of sustain pulse generating circuit 50. The sustain pulse generating circuit of sustain electrode driving circuit 44 has the following elements:

an electric power recovering circuit;

a switching element for clamping sustain electrodes SU1 through SUn on Vs; and a switching element for clamping sustain electrodes SU1 through SUn on 0 (V).

Thus, the sustain pulse generating circuit generates sustain pulse voltage Vs. The electric power recovering circuit recovers and reuses electric power when sustain electrodes SU1 through SUn are driven.

In the first embodiment, as initializing waveform generating circuit 53, a Miller integrating circuit including an FET that is practical and has a simple structure is employed. However, this present invention is not limited to this. Initializing waveform generating circuit 53 may be any circuit capable of generating ascent-ramp waveform voltage and descent-ramp waveform voltage.

Next, an operation of scan electrode driving circuit 53 and a method of controlling initializing voltage Vi2 are described with reference to the accompanying drawing.

Figure 11:
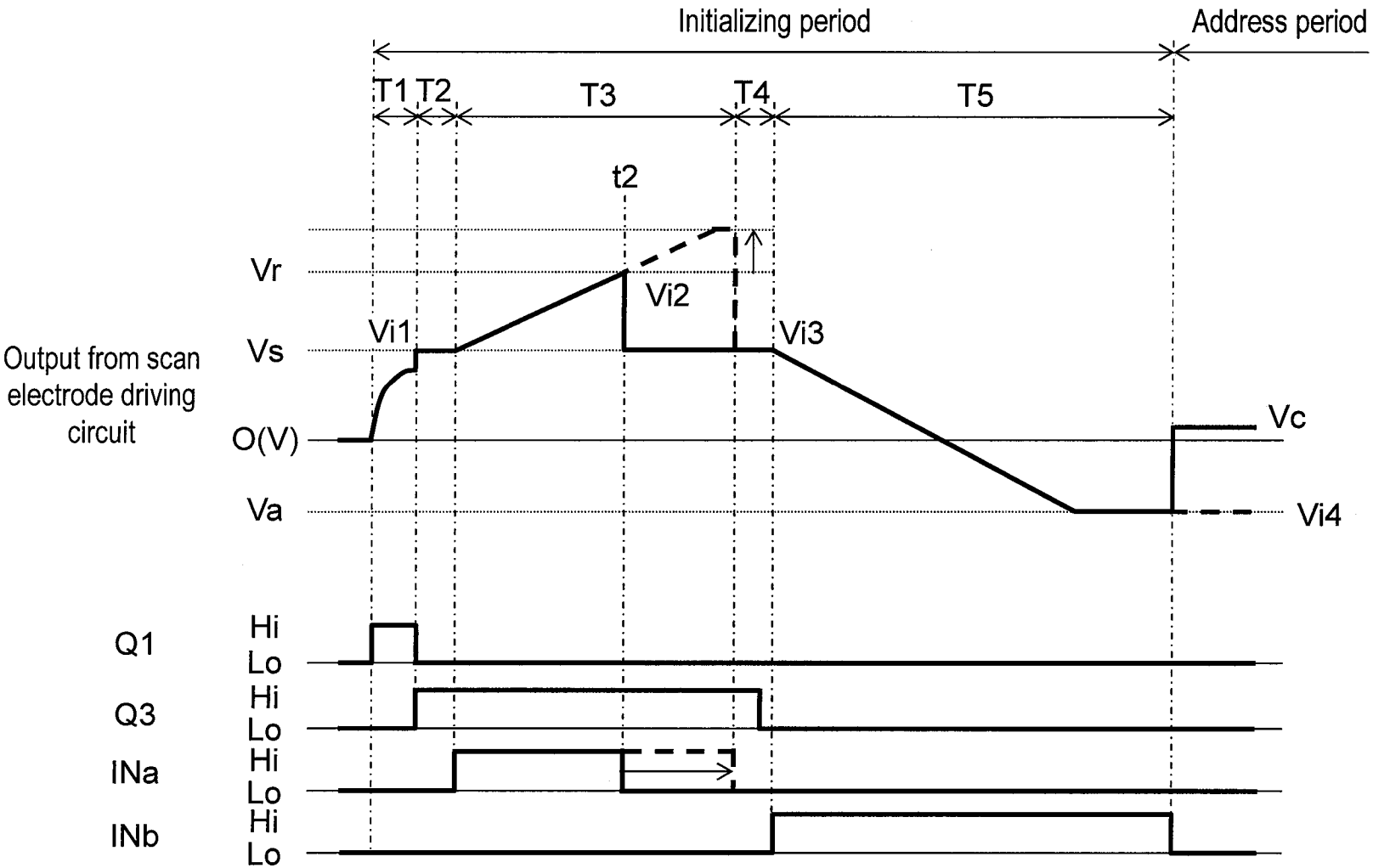
FIG. 11 is a timing chart for illustrating one example of the operation of the scan electrode driving circuit in the all-cell initializing operation of the present invention.

FIG. 11 is a timing chart for illustrating one example of the operation of scan electrode driving circuit 43 in the all-cell initializing operation in the first exemplary embodiment of the present invention. In FIG. 11, the driving voltage waveform for performing the all-cell initializing operation is divided into five time periods, namely time periods T1 through T5, and the time periods are described. It is assumed that voltage Vi1, voltage Vi3, and voltage Vi3' are equal to voltage Vs, voltage Vi2 is equal to voltage Vr, and voltage Vi4 is equal to negative voltage Va. It is also assumed that scan pulse generating circuit 54 outputs a signal to be input into switching elements QL1 through QLn, namely the voltage waveform of initializing waveform generating circuit 53, as it is.

In the following description, the operation of conducting a switching element is denoted with ON, and the shutting-off operation is denoted with OFF. In FIG. 11, a signal for setting the switching element at ON is denoted with "Hi", and a signal for setting it at OFF is denoted with "Lo".

(Time period T1)

Switching element Q1 of sustain pulse generating circuit 50 is firstly set at ON. At this time, inter-electrode capacity Cp resonates with inductor L1, and the voltage of scan electrodes SC1 through SCn starts to increase through capacitor C1 for recovering electric power, switching element Q1, diode D1, and inductor L1.

(Time period T2)

Next, Switching Element Q3 of Sustain Pulse Generating Circuit 50 is Set at ON. Voltage Vs is then applied to scan electrodes SC1 through SCn via switching element Q3, and the potential of scan electrodes SC1 through SCn becomes voltage Vs (equal to voltage Vi1 in the first embodiment).

(Time Period T3)

Next, input terminal INa of the Miller integrating circuit for generating the ascent-ramp waveform voltage is set at "Hi". Specifically, voltage 15 (V), for example, is applied to input terminal INa. Constant current then flows from resistor R10 toward capacitor C10, the source voltage of switching element Q11 increases like a ramp, and the output voltage of scan electrode driving circuit 43 also starts to increase like a ramp. This voltage increase continues while input terminal INa is in "Hi".

After the output voltage increases to voltage Vr (equal to initializing voltage Vi2 in the first embodiment), input terminal INa is set at "Lo". Specifically, voltage 0 (V), for example, is applied to input terminal INa.

Thus, ascent-ramp waveform voltage that gradually increases from voltage Vs that is not higher than the breakdown voltage to voltage Vr that is higher than the breakdown voltage is applied to scan electrodes SC1 through SCn.

Here, an example where input terminal INa is set at "Lo" at time t2 is shown. As shown in the broken line of FIG. 11, when the timing of setting input terminal INa at "Lo" is delayed and the period when input terminal INa is kept at "Hi" is extended, initializing voltage Vi2 can be further increased. Thus, by controlling the period when input terminal INa is kept at "Hi", initializing voltage Vi2 can be controlled.

(Time Period T4)

Input terminal INa is set at "Lo" and switching element Q3 is set at OFF, thereby preparing for occurrence of the subsequent descent-ramp waveform voltage (Time Period T5)

Next, input terminal INb of the Miller integrating circuit for generating the descent-ramp waveform voltage is set at "Hi". Specifically, voltage 15 (V), for example, is applied to input terminal INb. Constant current then flows from resistor R11 toward capacitor C12, the drain voltage of switching element Q14 decreases like a ramp, and the output voltage of scan electrode driving circuit 43 also starts to decrease like a ramp. After the output voltage of scan electrode driving circuit 43 reaches predetermined negative voltage Vi4L, input terminal INb is set at "Lo". Specifically, voltage 0 (V), for example, is applied to input terminal INb.

FIG. 11 shows a waveform chart where the ascent-ramp waveform voltage reaches initializing voltage Vi2 and is then immediately changed to voltage Vs and the descent-ramp waveform voltage reaches Vi4 and is then kept at this voltage for a certain time. This waveform simply depends on the circuitry of FIG. 10. The first embodiment is not limited to this waveform or the circuitry of FIG. 10. The configuration may be employed where the ascent-ramp waveform voltage reaches initializing voltage Vi2 and then may be kept at this voltage for a certain time. The configuration may be employed where the descent-ramp waveform voltage reaches Vi4 and is then immediately changed to voltage Vc.

Thus, scan electrode driving circuit 43 applies, to scan electrodes SC1 through SCn, the ascent-ramp waveform voltage that gradually increases from voltage Vi1 that is not higher than the breakdown voltage to voltage Vi2 that is higher than the breakdown voltage. Scan electrode driving circuit 43 then applies the descent-ramp waveform voltage that gradually decreases from voltage V13 to voltage V14.

Since scan electrode driving circuit 43 includes the circuitry shown in FIG. 10 in the first embodiment, the maximum voltage of the gradually increasing ascent-ramp waveform voltage, namely the voltage value of initializing voltage Vi2, can be easily controlled only by keeping the INa at "Hi" for a desired period.

In the first embodiment, the method of varying initializing voltage Vi2 is not limited to the above-mentioned method. The other various methods are considered for varying initializing voltage Vi2. For instance, initializing voltage Vi2 can be also controlled by controlling the gradient of the ascent-ramp of voltage Vi1 to initializing voltage Vi2.

In the first embodiment, as discussed above, the current-flow accumulative time of panel 10 is not measured, but the accumulative added value is calculated that increases with the current-flow accumulative time of panel 10 at an increasing rate that depends on the ratio of the display period of a still image to the unit time. When the ratio of the display period of the still image on the panel to the current-flow period in panel 10 is high, the variation in the driving voltage waveform can be generated earlier than that when the ratio is small. As a result, control of stably generating the discharge in response to the current-flow accumulative time of the panel and the image displayed on the panel, such as control of initializing voltage Vi2 in the all-cell initializing operation, can be optimally performed in response to the variation with time.

In the first embodiment, accumulative adding circuit 48A accumulatively adds predetermined values. However, a predetermined value may be subtracted from a predetermined initial value every unit time.

In the first embodiment, accumulative adding circuit 48A sets a plurality of accumulative addition thresholds, compares the accumulative added value supplied from third accumulative counter 74 with the accumulative addition thresholds, and increases initializing voltage Vi2 whenever the accumulative added value becomes each accumulative addition threshold or higher. However, the present invention is not limited to this. For example, initializing voltage Vi2 may be continuously increased with increase of the accumulative added value.

In the first embodiment, as discussed above, initializing voltage Vi2 is increased whenever the accumulative added value in accumulative adding circuit 48A becomes each accumulative addition threshold or higher. However, the following configuration may be employed. After the accumulative added value becomes each accumulative addition threshold or higher, and until the plasma display device temporarily comes into a non-operation state, driving by the driving waveform is continued as ever and initializing voltage Vi2 is varied at the timing of operation start. Specifically, even when accumulative adding circuit 48A outputs a signal for indicating that the accumulative added value becomes a predetermined accumulative addition threshold or higher in the operation state of plasma display device 1, timing generating circuit 45 outputs each timing signal for driving panel 10 as the same timing signal as ever. Here, the operation state of plasma display device 1 means that timing generating circuit 45 is in the operation state and outputs each timing signal for driving panel 10. Next, when the plasma display device is temporarily powered off, and then is powered on to start the driving of panel 10, timing generating circuit 45 may vary initializing voltage Vi2 and may output the timing signal for generating the ascent-ramp waveform voltage. This configuration can prevent fluctuation in brightness that can be generated by variation of the initializing waveform during the operation of plasma display device 1, and also can increase the image display quality.

In the first embodiment, as discussed above, accumulative adding circuit 48A determines the ratio of the display period of the still image to the unit time based on the output from still image judging circuit 46, increases the predetermined value and performs accumulative addition when the ratio is high, and increases initializing voltage Vi2 whenever the accumulative added value becomes each accumulative addition threshold or higher. However, the present invention is not limited to this. A similar advantage can be taken even by the following configuration. A current-flow accumulative time measuring circuit for measuring the accumulative time when the current is applied to panel 10, and a circuit for measuring the display period of the still image on panel 10 and calculating the ratio of it to the current-flow accumulative time are disposed, and initializing voltage Vi2 is varied based on the ratio and the current-flow accumulative time.

In the first embodiment, as discussed above, still image judging circuit 46 and accumulative adding circuit 48A have circuitry. However, a program may be prepared based on an algorism for achieving the same operation, installed in a microcomputer, and executed, for example.

The control for stably causing discharge based on the accumulative added value is not limited to the method of controlling initializing voltage Vi2, but may employ another driving waveform control method. In the present invention, it is noted that the discharge characteristic of the panel does not vary uniformly in response to the current-flow accumulative time but varies in response to the length of the display period of the image displayed on the panel, namely the still image. The present invention has the configuration that the accumulative added value increases with the current-flow accumulative time of panel 10 at an increasing rate that depends on the ratio of the display period of the still image to the unit time. In other words, the first embodiment can be applied to the whole method of controlling the driving waveform in response to the variation with time of the discharge characteristic.

Each specific numerical value such as each threshold or voltage value used in the first embodiment of the present invention is one example. The present invention is not limited to these numerical values. It is preferable to set optimal values according to the characteristic of the panel or specification of the plasma display device.

Second Exemplary Embodiment

A plasma display device in accordance with a second exemplary embodiment of the present invention is described with reference to the accompanying drawings.

The exploded perspective view showing the structure of panel 10 of the second exemplary embodiment of the present invention is the same as FIG. 1 used for description of the first exemplary embodiment. Therefore, detailed descriptions of the structure of panel 10 in the second exemplary embodiment using FIG. 1 are omitted.

The electrode array diagram of panel 10 in accordance with the second exemplary embodiment is the same as the diagram used for description of the first exemplary embodiment. Therefore, detail descriptions of the electrode array of panel 10 in the second exemplary embodiment using FIG. 2 are omitted.

Figure 12:
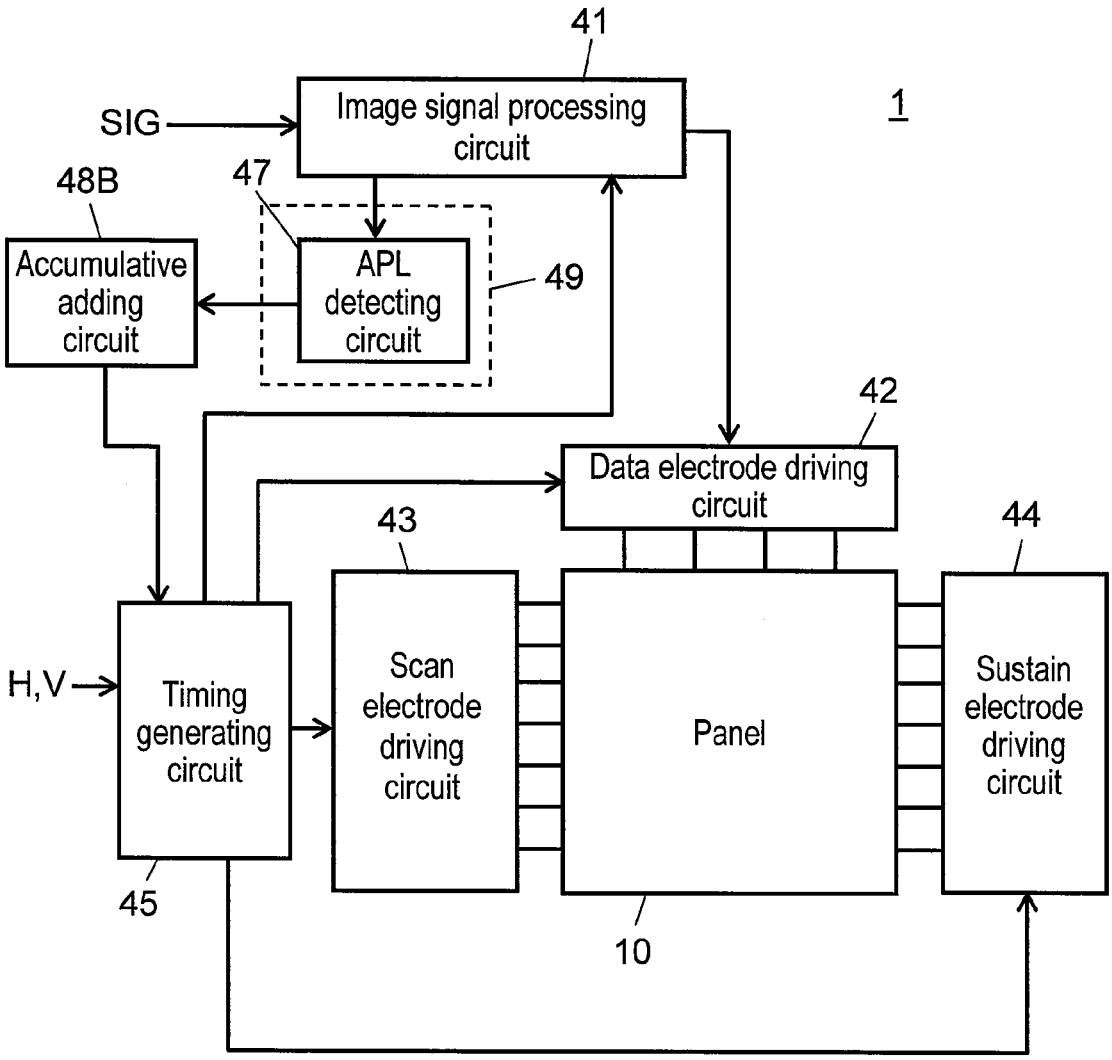
FIG. 12 is a circuit block diagram of a plasma display device in accordance with a second exemplary embodiment of the present invention.

Next, the configuration of the plasma display device of the second exemplary embodiment is described. FIG. 12 is a circuit block diagram of the plasma display device in accordance with the second exemplary embodiment of the present invention. Plasma display device 1 has the following elements:

- panel 10;
- image signal processing circuit 41;
- data electrode driving circuit 42;
- scan electrode driving circuit 43;
- sustain electrode driving circuit 44;
- timing generating circuit 45;
- average picture level (APL) detecting circuit 47;
- accumulative adding circuit 48B; and
- a power supply circuit (not shown) for supplying power required for each circuit block.

APL detecting circuit 47 is an example of image judging circuit 49 for determining the property of an image to be displayed on the panel and outputting a judgment result. In the second embodiment, the property of the image means the property from the viewpoint of the average picture level, for example.

The circuit block diagram of the plasma display device in FIG. 12 differs from FIG. 4 used for description of the first embodiment in that the plasma display device in FIG. 12 has accumulative adding circuit 48B and APL detecting circuit 47. Therefore, accumulative adding circuit 48B and APL detecting circuit 47 are mainly described, and detailed descriptions of the elements other than accumulative adding circuit 48B and APL detecting circuit 47 are omitted.

APL detecting circuit 47 detects the average brightness, namely average picture level (APL), of a display image of the video signal supplied from image signal processing circuit 41. The detection of the APL is achieved using a generally known method such as a method of accumulating the luminance value for one field period or one frame period. However, the signal obtained by applying contrast control or brightness control to the input video signal is displayed on panel 10, so that APL detecting circuit 47 detects the APL of the video signal having undergone the controls. Thus, APL detecting circuit 47 detects the APL of an image to be displayed on panel 10, and outputs the result.

While each driving circuit drives panel 10, namely while current is applied to panel 10, accumulative adding circuit 48B performs accumulative addition of adding and increasing predetermined values every unit time (30 minutes in the second embodiment). The accumulative addition result is not reset, but is increased with the current-flow accumulative time of the panel. Therefore, accumulative adding circuit 48B has a function as a current-flow accumulative time measuring circuit for measuring the accumulative time when each driving circuit drives panel 10. At this time, accumulative adding circuit 48B calculates the average value of the APL in the unit time by accumulating the outputs from APL detecting circuit 47 for the unit time or by another method. When the average value is large, accumulative adding circuit 48B increases the predetermined value and performs accumulative addition. Accumulative adding circuit 48B compares the accumulative added value with a predetermined threshold, and, when the accumulative addition result becomes the threshold or higher, outputs a signal showing the fact to timing generating circuit 45.

Timing generating circuit 45 generates various timing signals for controlling the operation of each circuit block based on horizontal synchronizing signal H, vertical synchronizing signal V, and the output from accumulative adding circuit 48B, and supplies them to respective circuit blocks. In the second embodiment, timing generating circuit 45 controls the voltage value of initializing voltage Vi2 of the ascent-ramp waveform voltage that is to be applied to scan electrodes SC1 through SCn in the initializing period based on the accumulative added value of accumulative adding circuit 48B. Timing generating circuit 45 outputs a corresponding timing signal to scan electrode driving circuit 43.

The circuitry of plasma display device 1 of the second exemplary embodiment has been described.

Figure 13:
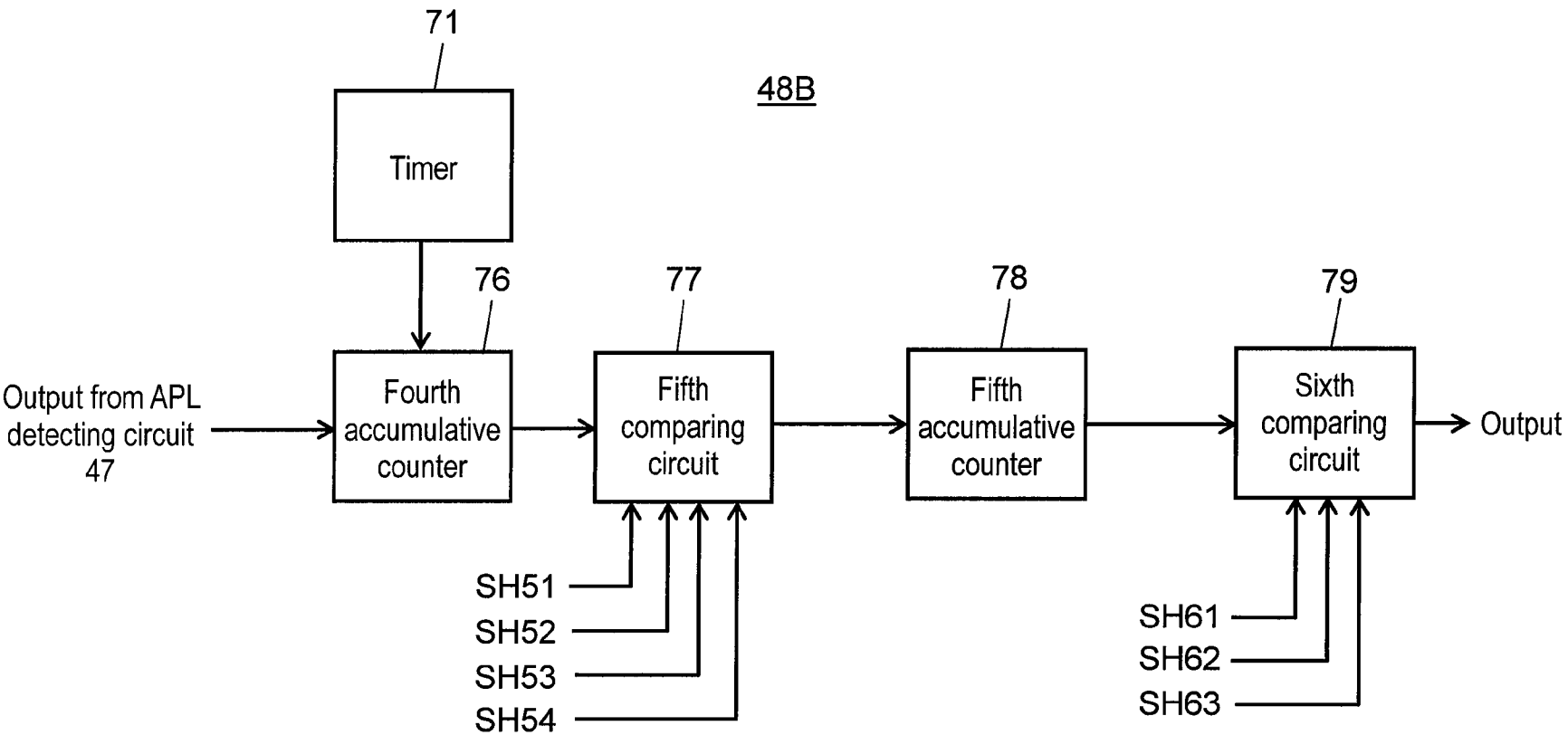
FIG. 13 is a circuit block diagram of an accumulative adding circuit in accordance with the second exemplary embodiment.

The configuration of accumulative adding circuit 48B is described. FIG. 13 is a circuit block diagram of accumulative adding circuit 48B of the second embodiment of the present invention. Accumulative adding circuit 48B has timer 71, fourth accumulative counter 76, fifth accumulative counter 78, fifth comparing circuit 77, and sixth comparing circuit 79.

Timer 71 has a generally known timer function for counting time. Timer 71 performs a timer operation while current is applied to panel 10, counts time in the unit time (here, 30 minutes) in the second embodiment, and outputs a signal indicating a lapse of the unit time whenever the unit time passes.

Fourth accumulative counter 76 operates in response to an output from APL detecting circuit 47 and an output from timer 71, and accumulatively adds the APLs supplied from APL detecting circuit 47 for the unit time (30 minutes). Fourth accumulative counter 76 calculates the total added value of the APLs in the unit time, divides the total added value by the total number of frames in the unit time (30 minutes), and calculates the average value of the APLs. Thus, every unit time, fourth accumulative counter 76 outputs the average value of the APLs in each unit time. Therefore, fourth accumulative counter 76 outputs a numerical value indicating the average value (hereinafter referred to as "average picture") of the APLs of a display image in the unit time (30 minutes). For example, when an image is displayed where APL is 0% in the whole period in the unit time (30 minutes), fourth accumulative counter 76 outputs the minimum value "0". When an image is displayed where APL is 100% in the whole period in the unit time (30 minutes), fourth accumulative counter 76 outputs the maximum value "100". This accumulative added value is reset every unit time so as to prevent addition for a plurality of unit times. The total added value in the unit time does not need to be divided by the total number of frames in the unit time, and in this case each threshold in subsequent fifth comparing circuit 77 is required to be set appropriately.

Fifth comparing circuit 77 compares the output value from fourth accumulative counter 76 with a predetermined threshold, determines the average picture in the unit time every unit time, and outputs a predetermined value corresponding to the judgment result. Fifth comparing circuit 77 determines the average picture by classifying it into fifth stages, and outputs one of numerical values "0" through "4" in response to the judgment result. Therefore, the comparison is performed using four thresholds, namely first average picture judging threshold SH51, second average picture judging threshold SH52, third average picture judging threshold SH53, and fourth average picture judging threshold SH54.

Specifically, the average picture is divided into fifth stages, namely smaller than 1%, 1% or larger and smaller than 10%, 10% or larger and smaller than 25%, 25% or larger and smaller than 50%, and 50% or larger. For the judgment, first average picture judging threshold SH51 is set at "1", second average picture judging threshold SH52 is set at "10", third average picture judging threshold SH53 is set at "25", and fourth average picture judging threshold SH54 is set at "50".

Fifth comparing circuit 77 outputs a predetermined value every unit time (30 minutes), namely "0" when the average picture in the unit time (30 minutes) is smaller than 1%, "1" when 1% or larger and smaller than 10%, "2" when 10% or larger and smaller than 25%, "3" when 25% or larger and smaller than 50%, or "4" when 50% or larger. When an image whose average picture is smaller than 1% is always displayed on panel 10, fifth comparing circuit 77 always outputs "0". When a bright image whose average picture is 50% or larger is always displayed on panel 10, fifth comparing circuit 77 always outputs "4". When an image of different brightness is displayed on panel 10, as in receiving of usual television broadcasting, fifth comparing circuit 77 outputs one of "0" through "4" corresponding to the display image. Each of these thresholds is one example, and may be optimally set in response to the type of the video signal, the specification of the plasma display device, or the characteristic of the panel. The number of thresholds is not limited to four, but may be five or more, or three or less.

Fifth accumulative counter 78 accumulatively adds predetermined values output from fifth comparing circuit 77 without resetting. Fifth accumulative counter 78 outputs the total added value of the predetermined values output from fifth comparing circuit 77 since the initial time of use of the plasma display device. Therefore, the numerical value output from fifth accumulative counter 78 increases with the current-flow accumulative time of panel 10, the rate of the increase is affected by the brightness of the image displayed on panel 10.

Sixth comparing circuit 79 compares the output value from fifth accumulative counter 78 with a predetermined threshold, and outputs a signal showing the result to timing generating circuit 45. Sixth comparing circuit 79 determines the output value from fifth accumulative counter 78 by classifying it into four stages. Therefore, sixth comparing circuit 79 performs the comparison using three thresholds, namely first accumulative addition threshold SH61, second accumulative addition threshold SH62, and third accumulative addition threshold SH63.

In the second embodiment, the first accumulative addition threshold is "800" (predetermined value "1"×1 hour/unit time of 30 minutes×400 hours=800) corresponding to current-flow accumulative time 400 hours when an image whose average picture is 1% or larger and is smaller than 10% is always displayed on panel 10. The second accumulative addition threshold is "1600" ("1"×2×800 hours=1600) corresponding to current-flow accumulative time 800 hours. The third accumulative addition threshold is "3200" ("1"×2×1600 hours=3200) corresponding to current-flow accumulative time 1600 hours. Each of these thresholds is simply one example, and may be optimally set in response to the specification of the plasma display device or the characteristic of the panel. The number of thresholds is not limited to three, but may be four or more, or two or less.

Accumulative adding circuit 48B may stop after the accumulative added value exceeds third accumulative addition threshold SH63 having the highest value.

Accumulative adding circuit 48B is further described in accordance with FIG. 7 used for description of the first embodiment. FIG. 7 is a diagram illustrating the operation of accumulative adding circuit 48B of the second embodiment. In FIG. 7, the horizontal axis shows the current-flow accumulative time to panel 10, and the vertical axis shows the accumulative added value as the output value from fifth accumulative counter 78 in accumulative adding circuit 48B.

For example, when a dark image whose average picture is 1% or larger and is smaller than 10% is always displayed on panel 10, fifth comparing circuit 77 always outputs "1". Therefore, the output value of fifth accumulative counter 78 gradually increases proportionally to the current-flow accumulative time of panel 10 as shown by graph GA of FIG. 7. When a bright image whose average picture is 50% or larger is always displayed on panel 10, fifth comparing circuit 77 always outputs "4". Therefore, the output value of fifth accumulative counter 78 increases at a gradient four times that of graph GA, as shown by graph GB of FIG. 7.

Therefore, in graph GA, the output value of fifth accumulative counter 78 becomes equal to "800" as first accumulative addition threshold SH61 when the current-flow accumulative time reaches 400 hours. In graph GB, the output value becomes equal to "800" when the current-flow accumulative time reaches 100 hours. In other words, in graph GB, the output value becomes first accumulative addition threshold SH61 in a time one-fourth of that of graph GA. Similarly, in graph GB showing the case that a bright image is always displayed on panel 10, output value reaches second accumulative addition threshold SH62 "1600" or third accumulative addition threshold SH63 "3200" in a time one-fourth of that of graph GA. Here, in graph GA, a dark image is always displayed on panel 10.

The longer the display period of the bright image on panel 10, the earlier the output value of fifth accumulative counter 78 reaches each accumulative addition threshold. In the second embodiment, accumulative adding circuit 48B has such a configuration for the following reason.

The discharge characteristic depends on the current-flow accumulative time of panel 10, and a factor such as discharge delay or dark current for making the discharge unstable depends on the current-flow accumulative time of panel 10. The discharge delay means a time delay after the voltage for causing discharge is applied to a discharge cell and until the discharge occurs actually. The dark current means the current occurring in the discharge cell regardless of the discharge. Therefore, applied voltage required for stably causing the discharge also depends on the current-flow accumulative time of panel 10.

FIG. 8 is a pattern diagram showing a relation between the current-flow accumulative time and breakdown voltage of the panel used in the description in the first embodiment. Also in the second embodiment, the pattern diagram showing a relation between the current-flow accumulative time and breakdown voltage of the panel is the same as FIG. 8. Therefore, the description of the relation between the current-flow accumulative time and breakdown voltage of the panel in FIG. 8 in the second embodiment focuses attention on typical contents of second embodiment.

Also in the second embodiment, the current-flow accumulative time of panel 10 is not simply measured, but the accumulative added value that increases with the current-flow accumulative time of panel 10 at an increasing rate that depends on the image to be displayed on panel 10.

The plasma display device of the second embodiment has APL detecting circuit 47 and accumulative adding circuit 48B. Accumulative adding circuit 48B outputs, from fifth comparing circuit 77, numerical values varied based on the average picture of the display image in the unit time, and accumulatively adds them with fifth accumulative counter 78. Thanks to this configuration, accumulative adding circuit 48B can perform not a simple timer operation where certain values are added periodically and accumulatively but a accumulative addition where added value depends on the brightness of the display image.

Thus, even when a bright image is displayed on panel 10 for a long time and the progress rate of the variation with time of the discharge characteristic is increased, a accumulative added value whose increment varies in response to the brightness of the display image can be calculated. Therefore, controlling the driving waveform based on the accumulative added value allows optimal control of stably causing the discharge in response to the variation with time.

In the second embodiment, it is assumed that the variation with time does not substantially progress when the display image is black in the whole area, and the discharge cell does not emit light or the light emission is negligibly feeble, and fifth comparing circuit 77 outputs "0" as a predetermined value. Specifically, this case means that the output value from fourth accumulative counter 76 indicating the average picture of the display image in the unit time is lower than first average picture judging threshold SH51 ("1") as a predetermined threshold, for example.

The control of the driving voltage waveform of the second embodiment is described.

The relation between the output value of accumulative adding circuit 48B and the ascent-ramp waveform voltage in the second embodiment is the same as that described in the first embodiment using FIG. 9.

As discussed above, the discharge characteristic varies with time, and the breakdown voltage gradually increases with increase in current-flow accumulative time of panel 10. When initializing voltage Vi2 is set with reference to the breakdown voltage of panel 10 having a short current-flow accumulative time, therefore, the breakdown voltage increases with increase in current-flow accumulative time, and hence initializing voltage Vi2 decreases relatively to the breakdown voltage. In this case, initializing discharge can become insufficient, sufficient wall voltage cannot be produced, priming can become insufficient, subsequent wiring discharge can become unstable, or the display quality of the image can degrade. Inversely, when initializing voltage Vi2 is previously set high in consideration of the variation with time of the discharge characteristic, the initializing discharge becomes strong beyond necessity in panel 10 of short current-flow accumulative time. As a result, light emission that is not related to the image display can become strong, the black luminance can increase, and the contrast can be reduced.

In other words, by increasing initializing voltage Vi2 in response to the increase in breakdown voltage following variation with time of the discharge characteristic, stable discharge display of high contrast is allowed regardless of the current-flow accumulative time.

In the second embodiment, initializing voltage Vi2 of the ascent-ramp waveform voltage in the all-cell initializing operation is controlled based on the comparison of the accumulative added value in accumulative adding circuit 48B with first accumulative addition threshold SH61 through third accumulative addition threshold SH63. Thus, stable address discharge can be achieved.

Specifically, as shown in FIG. 9, when the accumulative added value in accumulative adding circuit 48B is lower than first accumulative addition threshold SH61 "800", Vset as the difference between initializing voltage Vi2 and voltage Vi1 is set at 220 (V). When the accumulative added value is first accumulative addition threshold SH61 "800" or higher, and is lower than second accumulative addition threshold SH62 "1600", Vset is set at 250 (V). When the accumulative added value is second accumulative addition threshold SH62 "1600" or higher, and is lower than third accumulative addition threshold SH63 "3200", Vset is set at 267 (V). When the accumulative added value is third accumulative addition threshold SH63 "3200" or higher, Vset is set at 280 (V). The driving waveform is optimally controlled according to the current-flow accumulative time of the panel and the brightness of the image displayed on the panel, and stable address discharge is achieved.

Each voltage value of Vset is just one example, and may be optimally set in response to the specification of the plasma display device or the characteristic of the panel.

Next, the circuitry of scan electrode driving circuit 43 and its operation are the same as those described in the first embodiment using FIG. 10. Therefore, detailed descriptions of the circuitry of scan electrode driving circuit 43 and its operation of the second embodiment using FIG. 10 are omitted.

Next, the operation of initializing waveform generating circuit 53 and the method of controlling initializing voltage Vi2 in the second embodiment are the same as the operation of initializing waveform generating circuit 53 and the method of controlling initializing voltage Vi2 in the first embodiment described using FIG. 11. Therefore, detailed descriptions of the operation of initializing waveform generating circuit 53 and the method of controlling initializing voltage Vi2 in the second embodiment using FIG. 11 are omitted.

In the second embodiment, the method of changing initializing voltage Vi2 is not limited to the above-mentioned method, but another method may be employed. The various methods other than the above-mentioned method are considered for changing initializing voltage Vi2. For instance, initializing voltage Vi2 can be also controlled by controlling the gradient of the ascent-ramp of voltage Vi1 to initializing voltage Vi2.

In the second embodiment, as discussed above, the current-flow accumulative time of panel 10 is not simply measured, but the accumulative added value is calculated that increases with the current-flow accumulative time of panel 10 at an increasing rate that depends on the average picture of display image in the unit time. As a result, control of stably generating the discharge in response to the current-flow accumulative time of the panel and the image displayed on the panel, such as control of initializing voltage Vi2 in the all-cell initializing operation, can be performed.

In the second embodiment, accumulative adding circuit 48B accumulatively adds predetermined values. However, a predetermined value may be subtracted from a predetermined initial value in every unit time.

In the second embodiment, accumulative adding circuit 48B sets a plurality of accumulative addition thresholds, compares the accumulative added value supplied from fifth accumulative counter 78 with the accumulative addition threshold, and increases initializing voltage Vi2 whenever the accumulative added value becomes each accumulative addition threshold or higher. However, the present invention is not limited to this. For example, initializing voltage Vi2 may be continuously increased with increase of the accumulative added value.

In the second embodiment, as discussed above, initializing voltage Vi2 is increased whenever the accumulative added value in accumulative adding circuit 48B becomes each accumulative addition threshold or higher. However, the following configuration may be employed. After the accumulative added value becomes each accumulative addition threshold or higher, and until the plasma display device temporarily comes into a non-operation state, driving by the driving waveform is continued as ever and initializing voltage Vi2 is varied at the timing of operation start. Specifically, even when accumulative adding circuit 48B outputs a signal for indicating that the accumulative added value becomes a predetermined accumulative addition threshold or higher in the operation state of plasma display device 1, timing generating circuit 45 outputs each timing signal for driving panel 10 as the same timing signal as ever. Here, the operation state of plasma display device 1 means that timing generating circuit 45 is in the operation state and outputs each timing signal for driving panel 10. Next, when plasma display device 1 is temporarily powered off and then is powered on to start the driving of panel 10, timing generating circuit 45 may vary initializing voltage Vi2 and may output the timing signal for generating the ascent-ramp waveform voltage. This configuration can prevent fluctuation in brightness that can be generated by variation of the initializing waveform during the operation of plasma display device 1, and also can increase the image display quality.

In the second embodiment, as discussed above, accumulative adding circuit 48B has circuitry. However, a program may be prepared based on an algorism for achieving the same operation, installed in a microcomputer, and executed, for example.

The control for stably causing discharge based on the accumulative added value is not limited to a method of controlling initializing voltage Vi2, but may employ another driving waveform control method. In the present invention, it is noted that the discharge characteristic of the panel does not vary uniformly in response to the current-flow accumulative time but varies in response to the image displayed on the panel, namely the brightness of the displayed image. The present invention has the configuration that the accumulative added value is calculated that increases with the current-flow accumulative time of panel 10 at an increasing rate that depends on the average picture of the display image in the unit time. In other words, the second embodiment can be applied to the whole method of controlling the driving waveform in response to the variation with time of the discharge characteristic.

Each specific numerical value such as each threshold or each voltage value used in the second embodiment of the present invention is just one example. The present invention is not limited to these numerical values. It is preferable to set optimal values according to the characteristic of the panel or specification of the plasma display device.

As is clear from the descriptions of the first and second embodiments, the present invention allows optimal control of stably causing the discharge in response to the variation with time of the discharge characteristic that progresses in response to the current-flow accumulative time of the panel and the image displayed on the panel. Therefore, a plasma display device allowing improvement of the image display quality and a driving method of a panel can be provided.

INDUSTRIAL APPLICABILITY

The present invention allows optimal control of stably causing the discharge in response to the variation with time of the discharge characteristic that progresses in response to the current-flow accumulative time of the panel and the image displayed on the panel. Therefore, the present invention is useful as a plasma display device allowing improvement of the image display quality and a driving method of a panel.

The invention claimed is:

1. A plasma display device comprising:

a plasma display panel having a plurality of discharge cells, each of the discharge cells including a display electrode pair that is formed of a scan electrode and a sustain electrode;

a driving circuit for applying a driving voltage waveform to the display electrode pair and driving the plasma display panel;

a current-flow accumulative time measuring circuit for measuring a accumulative time when the driving circuit drives the plasma display panel; and an image judging circuit for judging a property of an image to be displayed on the plasma display panel and outputting a judgment result, wherein the driving circuit varies the driving voltage waveform in response to the accumulative time, and controls a time interval for varying the driving voltage waveform in response to the judgment result of the image judging circuit, wherein the image judging circuit is configured by a still image judging circuit for judging whether the image to be displayed on the plasma display panel is a still image, and outputting the judgment result, and the driving circuit varies the driving voltage waveform in response to the accumulative time, and controls a time interval for varying the driving voltage waveform in response to a ratio of a display period of the still image to the accumulative time, and wherein the driving voltage waveform includes a gradually increasing ramp waveform voltage applied to the scan electrode, and the driving circuit decreases a time interval for varying maximum voltage of the ramp waveform voltage, as the ratio of the display period of the still image to the accumulative time increases.

2. A driving method of a plasma display panel, the plasma display panel having a plurality of discharge cells, each of the discharge cells including a display electrode pair that is formed of a scan electrode and a sustain electrode, the driving method comprising:

forming a plurality of subfields, each of which having an initializing period, an address period, and a sustain period in one field period;

varying a driving voltage waveform in response to accumulative time when the plasma display panel is driven; and driving the plasma display panel, wherein a property of an image to be displayed on the plasma display panel is judged, and a judgment result is output, and wherein a time interval for varying the driving voltage waveform is controlled in response to the judgment result, and wherein the judgment denotes judging whether the image to be displayed on the plasma display panel is a still image, and the time interval for varying the driving voltage waveform is decreased as a ratio of a display period of the still image on the plasma display panel to the accumulative time increases.

3. A driving method of a plasma display panel, the plasma display panel having a plurality of discharge cells, each of the discharge cells including a display electrode pair that is formed of a scan electrode and a sustain electrode, the driving method comprising:

forming a plurality of subfields, each of which having an initializing period, an address period, and a sustain period in one field period;

varying a driving voltage waveform in response to accumulative time when the plasma display panel is driven; and driving the plasma display panel, wherein a property of an image to be displayed on the plasma display panel is judged, and a judgment result is output, and wherein a time interval for varying the driving voltage waveform is controlled in response to the judgment result, and wherein the judgment denotes judging whether the image to be displayed on the plasma display panel is a still image, and predetermined values are accumulatively added every predetermined unit time while the plasma display panel is driven, at least one subfield for applying a gradually increasing ramp waveform voltage to the scan electrode in the initializing period is included in one field period, and the ratio of display period of the still image on the plasma display panel to the unit time is judged every unit time, the predetermined values are increased as the ratio increases, and maximum voltage of the ramp waveform voltage is varied in response to the accumulatively added value.

* * * * *

UNITED STATES PATENT AND TRADEMARK OFFICE

CERTIFICATE OF CORRECTION

PATENT NO. : 8,358,255 B2
APPLICATION NO. : 12/296131
DATED : January 22, 2013
INVENTOR(S) : Yutaka Yoshihama et al.

It is certified that error appears in the above-identified patent and that said Letters Patent is hereby corrected as shown below:

On Title page 1, FOREIGN PATENT DOCUMENTS, delete duplicate entries:
"JP 09-138668 A 5/1997" and "JP 09138668 A 5/1997".

On Title page 2, FOREIGN PATENT DOCUMENTS, delete duplicate entries:
"JP 2002366088 A 12/2002";
"JP 200315590 A 1/2003";
"JP 2004061863 A 2/2004";
"JP 200691437 A 4/2006"; and
"JP 2007128089 A 5/2007".

Signed and Sealed this
Fourth Day of June, 2013

Teresa Stanek Rea
*Acting Director of the United States Patent and Trademark Office*